US005352568A

United States Patent [19]

Kuse et al.

[11] Patent Number: 5,352,568

[45] Date of Patent: Oct. 4, 1994

[54] PROCESSING METHOD AND BLEACHING SOLUTION FOR SILVER HALIDE COLOR PHOTOGRAPHIC LIGHT-SENSITIVE MATERIALS

[75] Inventors: Satoru Kuse; Masao Ishikawa; Shigeharu Koboshi; Masayuki Kurematsu, all of Hino, Japan

[73] Assignee: Konica Corporation, Tokyo, Japan

[21] Appl. No.: 104,828

[22] Filed: Aug. 11, 1993

Related U.S. Application Data

[63] Continuation of Ser. No. 982,015, Nov. 24, 1992, abandoned, which is a continuation of Ser. No. 804,487, Dec. 9, 1991, abandoned, which is a continuation of Ser. No. 626,338, Dec. 13, 1990, abandoned, which is a continuation of Ser. No. 309,817, Feb. 10, 1989, abandoned.

[30] Foreign Application Priority Data

| | | | |
|---|---|---|---|
| Feb. 15, 1988 | [JP] | Japan | 63-032501 |
| Mar. 25, 1988 | [JP] | Japan | 63-072781 |
| Dec. 13, 1988 | [JP] | Japan | 63-315958 |

[51] Int. Cl.[5] ..... G03C 7/40; G03C 7/42

[52] U.S. Cl. ..... 430/393; 430/398; 430/430; 430/461; 430/963

[58] Field of Search ..... 430/393, 398, 430, 461, 430/963

[56] References Cited

U.S. PATENT DOCUMENTS

| | | | |
|---|---|---|---|
| H,789 | 6/1990 | Ueda et al. | 430/393 |
| 4,242,442 | 12/1980 | Idota | 430/430 |
| 4,818,664 | 4/1989 | Ueda et al. | 430/430 |
| 4,822,725 | 4/1989 | Abe et al. | 430/430 |
| 4,845,017 | 7/1989 | Kishimoto et al. | 430/430 |
| 4,923,785 | 5/1990 | Stephan et al. | 430/393 |
| 4,933,266 | 6/1990 | Frank | 430/393 |
| 4,983,503 | 1/1991 | Ishikawa et al. | 430/393 |
| 4,985,347 | 1/1991 | Fujimoto et al. | 430/430 |

FOREIGN PATENT DOCUMENTS

| | | | |
|---|---|---|---|
| 0158369 | 10/1985 | European Pat. Off. . | |
| 0293729 | 12/1988 | European Pat. Off. | 430/461 |
| 3518257 | 11/1985 | Fed. Rep. of Germany . | |
| 3097953 | 4/1988 | Japan | 430/430 |

*Primary Examiner*—Richard L. Schilling
*Attorney, Agent, or Firm*—Jordan B. Bierman

[57] ABSTRACT

A processing method for silver halide color photographic material and a bleaching solution used in the processing are disclosed. Sufficient desilvering in a short time and prevention of bleaching fogging can be obtained by the process. The process is applicable for silver-rich high-sensitivity color light-sensitive material. The bleaching solution comprises a of a ferric complex salts of compounds represented by the following Formula A or B in an amount of at least 0.01 mol per liter of the bleaching solution and a buffer agent capable of adjusting pH value to 3 to 7; and pH value of the bleaching solution is held within the range of from 3 to 7;

Formula A

Formula B wherein $A_1$ through $A_4$ are each $—CH_2OH$, —COOM, or $—PO_3M_1M_2$; M, $M_1$ and $M_3$ are each a hydrogen atom, a sodium atom, a potassium atom or an ammonium group; X is a substituted or unsubstituted alkylene group having three to six carbon atoms; $B_1$ and $B_2$ are a substituted or unsubstituted alkylene group having two to five carbon atoms; n is an integer of 1 to 8.

11 Claims, No Drawings

PROCESSING METHOD AND BLEACHING SOLUTION FOR SILVER HALIDE COLOR PHOTOGRAPHIC LIGHT-SENSITIVE MATERIALS

This application is a continuation of application Ser. No. 07/982,015, filed Nov. 24, 1992, now abandoned, which is a continuation of application Ser. No. 07/804,487, filed Dec. 9, 1991, now abandoned, which is a continuation of application Ser. No. 07/626,338, filed Dec. 13, 1990, now abandoned, which is a continuation of application Ser. No. 07/309,817, filed Feb. 10, 1989, now abandoned.

FIELD OF THE INVENTION

The present invention relates to a processing method for silver halide color photographic light-sensitive materials (hereinafter also simply referred to as "light-sensitive meterials") and a bleaching solution suitable for said processing method, specifically to a processing method and bleaching solution permitting sufficient desilvering in a short time and prevention of bleach fogging; this art can function well even in use for silver-rich high-sensitivity light-sensitive materials.

BACKGROUND OF THE INVENTION

Light-sensitive material processing basically comprises color developing and desilvering processes; desilvering comprises bleaching and fixing processes or a bleach-fixing process. Rinsing, stabilization and other processes may be added.

In processing solution with bleaching capability used to desilver light-sensitive materials, ferricyanates, bichromates, and other inorganic oxidizing agents have conventionally been widely used to bleach image silver.

However, some critical drawbacks are pointed out in processing solutions with bleaching capability containing these inorganic oxidizing agents. For example, ferricyanates and bichromates are undersirable in preventing environmental pollution in that they may be decomposed by light to produce harmful cyan ions or hexavalent chromium ions, though they are relatively high in image silver bleaching power. Another drawback is that it is difficult to regenerate fro reusing these processing solutions without discarding the waste liquid after processing.

In response to the requirements of less problems of environmental pollution, rapid and simple processing, reuse of waste liquid, and others, processing solutions containing metal complex salts of organic acids, such as aminopolycarboxylic acid, as oxidizing agent have become used. However, such processing solutions are faulty in that the bleaching rate (oxidation rate) of image silver (metallic silver) formed in the developing process is low due to weak oxidation power. For example, iron (III) complex salt of ethylenediaminetetraacetic acid, considered relatively strong in bleaching power among metal complex salts of aminopolycarboxylic acid, is now in practical use in bleaching solutions and bleach-fixers, but it is faulty in that bleaching power is insufficient and much time is taken in the bleaching process when used for high-sensitivity silver halide color photographic light-sensitive materials composed mainly of a silver bromide or silver iodobromide emulsion, specifically silver-rich color paper for picture taking and color negative and color reversal films for picture taking which contain silver iodide.

In addition, developing methods using automatic developing machine etc. to continuously process large amounts of light-sensitive materials necessitate a means of keeping the processing solution components in a given range of concentration to avoid reduction of bleacher performance due to changes in component concentrations. To meet this requirement, as well as to increase economy and prevent environmental pollution, some methods were proposed, including the method in which concentrated replenishers are added in small amounts and the method in which overflow solutions are supplemented with regenerating agents and then reused as replenishers.

As regards bleachers, a method is now in practical use in which a ferrous complex salt of organic acid formed in bleaching developed silver, e.g. iron (II) complex salt of ethylenediaminetetraacetic acid, is oxidized by airation to iron (III) complex salt of ethylenediaminetetraacetic acid, i.e. ferric complex salt of organic acid, and a ragenerating agent is added to replenish the deficient components, then the solution is used as a replenisher.

In recent years, however, what is called compact-labos (also called minilabos) have become widely established with the aim of reducing processing time for silver halide color photographic light-sensitive materials and delivery cost; in these labos, there are severe needs of process simplification and reduction of developing machine installation space, so regeneration is unsuitable since it necessitates troublesome procedures and maintenance, as well as additional processing space.

It is therefore preferable to use the replenishing method with small amounts of thick replenishers without regenerating process; however, when the amount of replenisher is extremely small, there occurs an increase in the concentration of color developer components transferred to the bleaching solution, and the solution becomes likely to be affected by evaporative concentration; these increase the accumulation of color developer components. As stated above, when the color developer component concentration in the bleaching solution increases, there occurs an increase in the ratio of contaminant reducing components, such as color developing agent and sulfites, bleaching reaction is inhibited, and what is called desilvering failure becomes likely to occur. To overcome these drawbacks, it was proposed to use ferric complex salts of aminopolycarboxylic acid disclosed in Research Disclosure No. 24023 and Japanese Patent Publication Open to Public Inspection No. 62-222252/1987 and their mixtures. However, even this method proved to have various drawbacks. For example, ferric complex salts of 1,3-propanediaminetetraacetic acid, disclosed in the above literature, are faulty in that bleach fogging occurs when it is used to bleach silver-rich high-sensitivity light-sensitive materials for a long time. Accordingly, the use of these salts or mixtures as bleaching agents causes bleach fogging in color-sensitized high-sensitivity light-sensitive materials composed mainly of a silver chloroiodide or silver iodobromide emulsion, specifically ultrahigh-speed (e.g. 400 to 3200 ASA) color negative films for picture taking incorporating a silver-rich emulsion, though it allows us to accomplish the desired purpose in bleaching or bleach-fixing low-speed light-sensitive materials composed mainly of a silver chlorobromide emulsion. This drawback becomes more serious when the amount of bleacher replenisher is reduced. Also, this tendency was found to become stronger when the color developing agent is present at concentrations of over $1.5\times10^{-2}$ mol in the color develope to be used in developing process arrayed before the bleaching process.

For these reasons, it is desired that a desilvering method and bleaching solution applicable to process high-sensitivity silver-rich light-sensitive materials without bleach fogging will be developed.

SUMMARY OF THE INVENTION

The object of the present invention is to provide a processing method with inhibited bleach fogging and a bleaching solution which functions well in embodying said processing method.

The above object of the invention is achieved by a method for processing a silver halide color photographic light-sensitive material comprising steps of developing the light-sensitive material with a color developer, bleaching, immediately after the developing step, the light sensitive material with a bleaching solution, and treating, after the bleaching step, the light-sensitive material with a solution having fixing capability, wherein the bleaching solution comprises at least one of ferric complex salts of compounds represented by the following Formula A or B in an amount of at least 0.01 mol per liter of the bleaching solution and a buffer agent capable of adjusting pH value to 3 to 7; and pH value of the bleaching solution is held within the range of from 3 to 7;

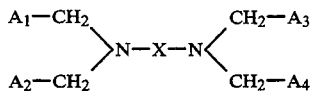

Formula A wherein A, through A are each a —$CH_2OH$ group, a —COOM group, or a —$PO_3M_1M_2$ group, which may be the same with or different from each other, M, $M_1$ and $M_3$ are each a hydrogen atom, a sodium atom, a potassium atom or an ammonium group; X is a substituted or unsubstituted alkylene group having three to six carbon atoms,

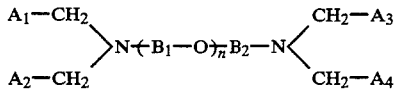

Formula B wherein $A_1$ through $A_4$ are the same as denoted in Formula A; n is an integer of 1 to 8; and $B_1$ and $B_2$, which may be the same or different from each other, are a substituted or unsubstituted alkylene group having two to five carbon atoms.

In the present invention, a bleaching treatment is carried out and a treatment with a fixer or a bleach-fixer is performed following to the bleaching treatment.

DETAILED DESCRIPTION OF THE INVENTION

In such processed the desired effect can be displayed when the bleaching solution contains both a particular ferric complex salt of organic acid and a buffer agent capable of adjusting to pH 3 to 7, so that and a pH value of the solution is kept at pH 3 to 7. A lack of any of these requirements interfere with the present invention.

The compound represented by Formula A is described in detail below.

$A_1$ through $A_4$ independently represent —$CH_2OH$, —COOM or —$PO_3M_1M_2$, whether identical or not; M, $M_1$ and $M_2$ independently represent a hydrogen atom, sodium, potassium or ammonium; X represents a substituted or unsubstituted alkylene group having 3 to 6 carbon atoms such as propylene, butylene, trimethylene, tetramethylene, pentamethylene; the substituent includes hydroxyl group and alkyl groups having 1 to 3 carbon atoms.

Examples of preferred compounds of Formula A are given below.

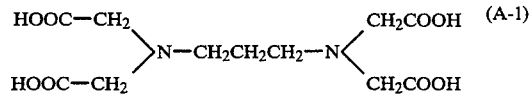

(A-1)

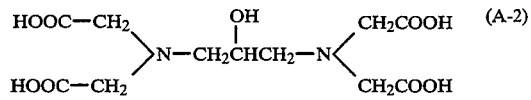

(A-2)

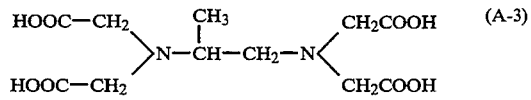

(A-3)

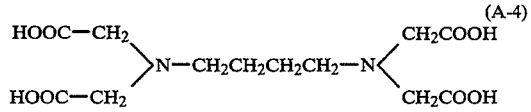

(A-4)

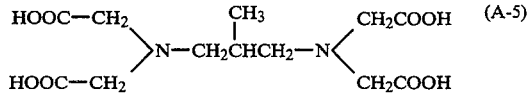

(A-5)

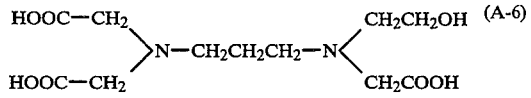

(A-6)

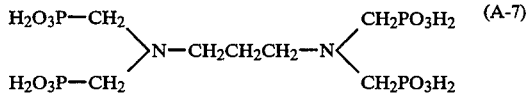

(A-7)

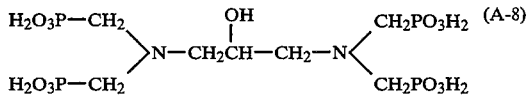

(A-8)

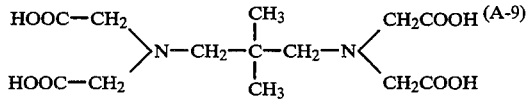

(A-9)

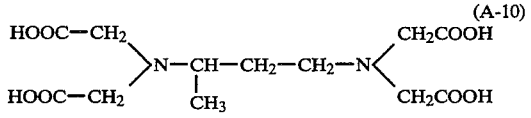

(A-10)

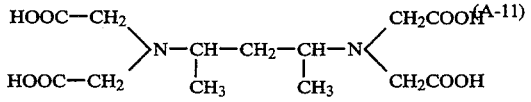

(A-11)

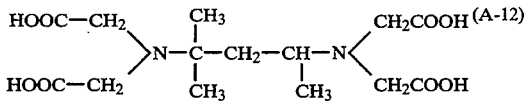

(A-12)

These compounds (A-1) through (A-12) may be arbitrarily used in the form of sodium, potassium or ammonium salts. From the veiwpoint of the desired effect of the invention and solubility, it is preferable to use ammonium salts of ferric complex salts of these compounds.

Of these compounds, (A-1), (A-4), (A-7) and (A-9) are preferably used for the present invention; (A-1) is especially preferable.

The compound represented by Formula B is described in detail below.

$A_1$ through $A_4$ have the same definitions as above; n represents any one of the integers 1 through 8; $B_1$ and $B_2$ independently represent a substituted or unsubstituted alkylene group having 2 to 5 carbon atoms such as ethylene, propylene, butylene, pentamethylene; the substituent includes hydroxyl group and lower alkyls having 1 to 3 carbon atoms such a methyl, ethyl, propyl group.

Examples of preferred compounds of Formula B are given below.

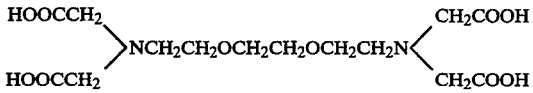
(B-1)

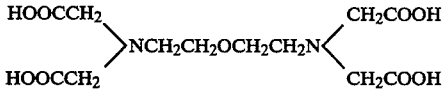
(B-2)

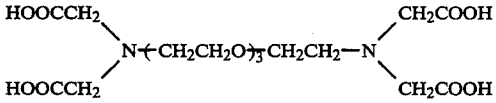
(B-3)

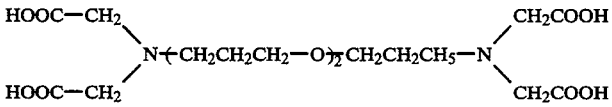
(B-4)

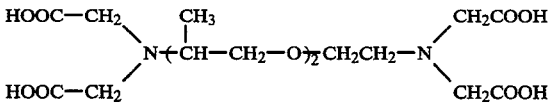
(B-5)

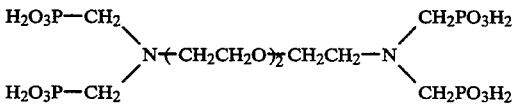
(B-6)

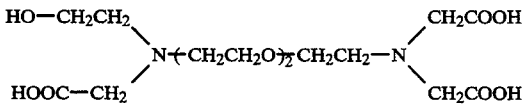
(B-7)

These compounds (B-1) through (B-7) may be arbitrarily used in the form of sodium, potassium or ammonium salts. From the veiwpoint of the desired effect and solubility, it is preferable to use ammonium salts of ferric complex salts of these compounds.

Of these compounds, (B-1), (B-4) and (B-7) are preferably used for the present invention; (B-1) is especially preferable.

In the present invention compounds of Formula A or B may be used singly or in combination.

Ferric complex salts of these compounds of Formulae A or B are used at ratios of at least 0.1 mol per 1 bleaching solution, preferably 0.01 to 1.0 mol/l, more preferably 0.1 to 1.0 mol/l, ideally 0.15 to 0.8 mol/l. From the viewpoint of cost and solubility, it is preferable to limit the amount of ferric complex salts of compounds of Formula A or B in the above range.

Examples of bleaching agents preferably used in combination with compounds of Formula A or B in the bleaching solution of the present invention include the following compounds.

(A'-1) Ethylenediaminetetraacetic acid or its salt (e.g. ammonium, sodium, potassium, triethanolamine salts)
(A'-2) Trans-1,2-cyclohexanediaminetetraacetic acid or its salt (ditto)
(A'-3) Dihydroxyethylglycinic acid or its salt (ditto)
(A'-4) Ethylenediaminetetrakismethylenephosphonic acid or its salt (ditto)
(A'-5) Nitrilotrimethylenephosphonic acid or its salt (ditto)
(A'-6) Diethylenetriaminepentakismethylenephosphonic acid or its salt (ditto)
(A'-7) Diethylenetriaminepentaacetic acid or its salt (ditto)
(A'-8) Ethylenediaminediorthohydroxyphenylacetic acid or its salt (ditto)
(A'-9) Hydroxyethylethylenediaminetriacetic acid or its salt (ditto)
(A'-10) Ethylenediaminepropionic acid or its salt (ditto)
(A'-11) Ethylenediaminediacetic acid or its salt (ditto)
(A'-12) Glycoletherdiaminetetraacetic acid or its salt (ditto)
(A'-13) Hydroxyethyliminodiacetic acid or its salt (ditto)
(A'-14) Nitrilotriacetic acid or its salt (ditto)
(A'-15) Nitrilotripropionic acid or its salt (ditto)
(A'-16) Triethylenetetraminehexaacetic acid or its salt (ditto)

(A'-17) Ethylenediaminetetrapropionic acid or its salt (ditto)

Note that these compounds are not to be construed as limitations.

Of these compounds, A'-1, A'-2, A'-7 and A'-12 are especially preferable.

These aminopolycarboxylic acids may be used in the form of iron (III) complex salts or bound in a solution with iron (III) salts, e.g. ferric sulfate, ferric chloride, ferric acetate, ferric sulfate, ferric ammonium sulfate and ferric phosphate, to form iron (III) ion complex salts. When using in the form of complex salts, it is possible to use one or more complex salts. When using ferric salts and aminocarboxylic acid to form complex salts in a solution, it is possible to use one or more ferric salts. It is also possible to use one or more aminopolycarboxylic acids. In any case, aminopolycarboxylic acids may be used in excess of the level necessary to form iron (III) ion complex salts. Aminopolycarboxylic acids and iron complex salts may be used in the form of ammonium, sodium, potassium or triethanolamine salts, or in combination.

Also, bleaching solutions containing the above iron (III) ion complex(es) may contain metal ion complex salts of cobalt, copper, nickel, zinc and other metals as well.

The term "buffer agent capable of adjusting to pH 3 to 7", used for the present invention is defined as a buffer agent which necessitates the addition of $K_2CO_3$ at ratios of over 5 g/l to adjust the aqueous solution containing a given amount of the buffer to pH 3 to 7. Examples of preferable buffers include the organic compounds represented by the following Formula I, II or III, and inorganic compounds having at least one nitrogen, phosphorus or boron atom.

Formula I

A—COOH

Wherein A represents a hydrogen atom or organic group.

Formula II

B—$PO_3H_2$

Wherein B represents a hydrogen atom or organic group.

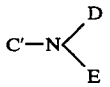

Formula III

Wherein C', D and E independently represent a hydrogen atom or organic group, and at least one of C', D and E represent an organic compound group.

The buff agents preferably used for the present invention are listed below.

The preferable fatty acid compounds include acrylic acid, adipinic acid, acetylenedicarboxylic acid, acetoacetic acid, azelaic acid, isocrotonic acid, isopropylmalonic acid, isobutyric acid, itachonic acid, isovaleric acid, ethylmalonic acid, capronic acid, formic acid, valeric acid, citric acid, glycolic acid, glutaric acid, crotonic acid, chlorofumaric acid, α-chloropropionic acid, gluconic acid, glyceric acid, β-chloropropionic acid, succinic acid, cyanoacetic acid, diethylacetic acid, diethylmalonic acid, dichloroacetic acid, citraconic acid, dimethylmalonic acid, oxalic acid, d-tartaric acid, meso-tartaric acid, trichlorolactic acid, tricarbarylic acid, trimethylacetic acid, lactic acid, vinylacetic acid, pimelic acid, pyrotartaric acid, racemic acid, fumaric acid propionic acid, prpopylmalonic acid, maleic acid, malonic acid, mesaconic acid, methylmalonic acid, monochloroacetic acid, n-butyric acid, malic acid, aspartic acid, DL-alanine, glutaminic acid and 3,3-dimethyl-glutaric acid.

The preferable acids having a cyclic structure include ascorbic acid, atropic acid, allocinnamic acid, benzoic acid, isophthalic acid, oxybenzoic acid (m-, p-), chlorobenzoic acid (o-, m-, p-), chlorophenylacetic acid (o-, m-, p-), cinnamic acid, salicylic acid, dioxybenzoic acid (2,3-, 2,4-, 2,5-, 2,6-, 3,4-, 3,5), cyclobutane-1,1-dicarboxylic acid, cyclobutane-1,2-dicarboxylic acid (trans-, cis-), cyclopropane-1,1-dicarboxylic acid, cycropropane-1,2-dicarboxylic acid (trans-, cis-), cyclohexane-1,1-dicarboxylic acid, cyclohexane-1,2-dicarboxylic acid (trans-, cis-), cyclohexylacetic acid, cyclopentane-1,1-dicarboxylic acid, 3,5-dinitrobenzoic acid, 2,4-dinitrophenoldiphenyl acid, sulfanylic acid, teraphthalic acid, toluic acid (o-, m-, p-), naphthoic acid (α-, β-), nicotinic acid, nitroanisole (o-, m-, p-), nitrobenzoic acid, nitrophenylic acid (o-, m-, p-), p-nitrophnetole, pyromucoic acid, uric acid, hippuric acid, barbituric acid, picolinic acid, violuric acid, phenylacetic acid, phenyl acid, phthalic acid, fluorobenzoic acid (o-, m-, p-), bromobenzoic acid (o-, m-, p-) , hexahydrobenzoic acid, benzylic acid, dl-madelic acid, mesitylenic acid, methoxybenzoic acid (o-, m-, p-) , methoxycinnamic acid (o-, m-, p-) , p-methoxyphenylacetic acid, gallic acid, and aminobenzoic acid (o-, m-, p-).

The preferable amine compounds include isoamylamine, isobutylamine, isopropylamine, ethylamine, ethylenediamine, diisoamylmaine, diisobutylamine, diethylamine, diethylenetriamine, dipropylamine, dimethylamine, tetraethylenepentaamine, tetramethylenediamine, triethylamine, trimethylamine, trimethyldiamine, m-butylamine, sec-butylamine, tert-butylamine, tert-butylamine, m-propylamine, pentamethylenediamine, hexamethylenetetraamine, quinoline, o-toluidine, aminobenzenesulfonic acid (o-, m-, p-) , N-methylbenzylamine, methylbenzylamine (o-, m-, p-) , 2-methylpiperidine, N-methoxybenzylamine, methoxybenzylamine (o-, m-, p-), benzylamine, coniine, diethylbenzylamine, cyclohexylamine, and piperazine.

The preferable inorganic acids include nitrous acid, phosphorous acid, hypophosphorous acid, boric acid, phosphoric acid, pyrophosphoric acid, triphosphoric acid, metatriphosphoric acid, polyphosphoric acid, and polymetaphosphoric acid.

The other preferable compounds include N- (2-acetamido) iminodiacetic acid, N- (2-acetamido) -2-aminoethanesulfonic acid, bis(2-hydroxyethyl ) imino-tris- (hydroxymethyl) methane, 2- (N-morpholino) ethanesulfonic acid, 3- (N-morpholino) -2-hydroxypropanesulfonic acid, piperazine-N,N'-bis (2-ethanesulfonic acid), ethylenediaminediacetic acid, ethylenediamine-2-propionic acid, and β-aminoethyliminodiacetic acid; also included are organic phosphoric acids such as amino-methylphosphono-N,N-diacetic acid, 2-phosphonoethyliminodiacetic acid, 2-phosphonobutane-1,2,4-tricarboxylic acid and the following:

(P-1)
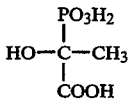
(P-2)
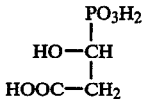
(P-3)
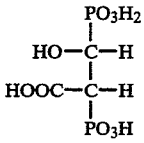
(P-4)
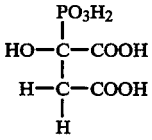
(P-5)
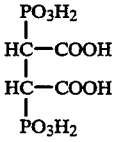
(P-6)
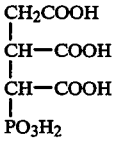
(P-7)
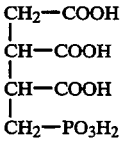
(P-8)
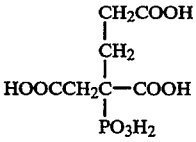
(P-9)
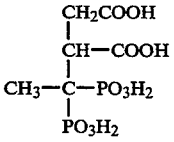
(P-10)
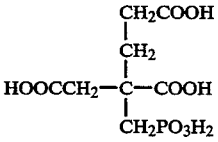
(P-11)
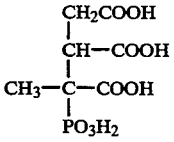
-continued
(P-12)
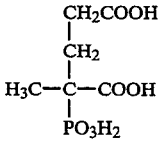
(P-13)
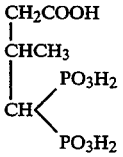
(P-14)
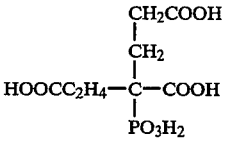
(P-15)
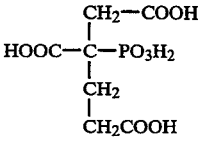
(P-16)
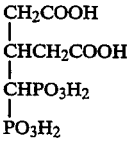
(P-17)
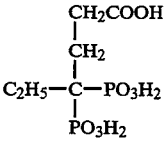
(P-18)
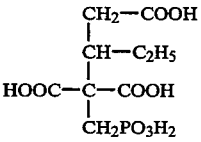
(P-19)
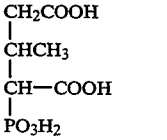
(P-20)
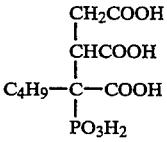
(P-21)
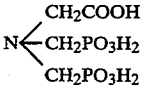
(P-22)
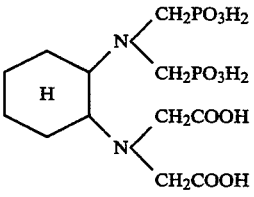

-continued (P-23)

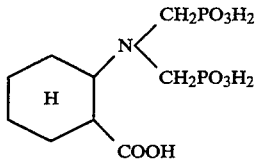

(P-24)

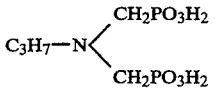

(P-25)

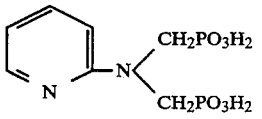

(P-26)

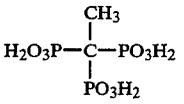

(P-27)

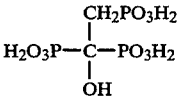

(P-28)

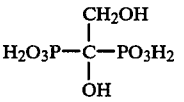

(P-29)

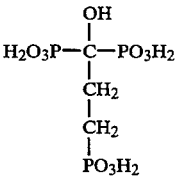

(P-30)

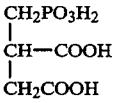

(P-31)

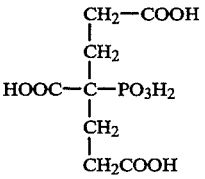

(P-32)

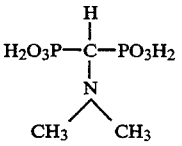

(P-33)

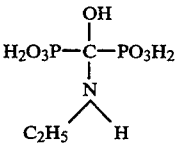

-continued (P-34)

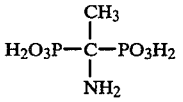

Of these compounds, fatty acids, cyclic acids, amine compounds and inorganic salts are preferable; fatty acids and amine compounds are more preferable; lower carboxylic acids, specifically those having 2 to 6 carbon atoms, are still more preferable.

It is preferable that these buffer compounds be added to the bleaching solution at 0.01 to 3.0 mol/l, more preferably 0.02 to 2.0 mol/l most preferably 0.1 to 2.0 mol/l. From the viewpoint of cost, solubility and bleaching performance, it is preferable to establish an upper limit of the amount of a buffer agent of the invention in the above-mentioned range.

Particularly, when a ferric complex salt of the compounds represented by Formulae A and B is used at 0.3 to 1.0 mol per 1 beaching solution, it is preferable to add said buffer agent at 0.1 to 2.0 mol/l.

Note that acetic acid, an organic acid, is slightly inferior to the above compounds in effectiveness.

It is found, however, that when a ferric complex salt of the compound of Formula A or B forms over 40% (molar ratio), preferably 50% (molar ratio) of the ferric complex salts of aminopolycarboxylic (or phosphonic) acid contained as bleaching agents, or when a ferric complex salt of the compound of Formula A or B is present at a ratio of over 0.2 mol/l, acetic acid is very effective for solution stability or preventive effect on suspended solids in the range of from 0.5 to 3 mol/l, preferably 0.8 to 2 mol/l.

The pH of a bleaching agent of the present invention is in the range of from 3 to 7; from the viewpoint of the effect of the invention, it is preferable that the pH be in the range of from 4 to 6, ideally 4.5 to 5.8.

It is preferable to use a bleaching solution of the present invention at 5° to 80° C., more preferably 20° to 45° C., still more preferably 25° to 42° C.

It is preferable that the amount of replenisher for a bleaching solution of the invention be 20 to 500 ml per $m^2$ light-sensitive material, more preferably 30 to 350 ml, still more preferably 40 to 300 ml, ideally 50 to 250 ml.

It is preferable to add halides such as ammonium bromide and ammonium chloride to a bleaching sulution of the invention; these halides are preferably added at 0.1 to 5 mol/l, more preferably 0.3 to 3 mol/l.

A bleaching agent of the present invention may contain various brightening agents, defoaming agents and surfactants.

The processing solutions with fixing capability of the present invention, namely fixer and bleach-fixer, necessitate the addition of what is called fixing agent.

Fixing agents include compounds which react with silver halide to form a water-soluble complex salt, e.g. thiosulfates such as potassium thiosulfate, sodium thiosulfate and ammonium thiosulfate; thiocyanates such as potassium thiosyanate, sodium thiocyanate and ammonium thiocyanate; thioureas; thioethers, and halides such as iodides.

The fixer and bleach-fixer may contain one or more pH buffers comprising various acids and salts such as boric acid, borax, sodium hydroxide, potassium hydroxide, sodium carbonate, potassium carbonate, sodium bicarbonate, potassium bicarbonate, acetic acid, sodium acetate and ammonium hydroxide, as well as fixing agent.

It is also desirable to add a large amount of a rehalogenating agent including, alkali halide and ammonium halide, such as potassium bromide, sodium bromide, sodium chloride, or ammonium bromide. Also, it is possible to add, as appropriate, substances known to be usually added to the fixer and bleach-fixer, such as pH buffers, e.g. borates, oxalates, acetates, carbonates, phosphates; alkylamines and polyethyleneoxides.

The above fixing agents are normally used at over 0.1 mol per 1 processing solution; from the viewpoint of the desired effect of the invention, it is preferable to use these agents in the range of from 0.6 to 4 mols, more preferably 0.9 to 3.0 mols, still more preferably 1.1 to 2.0 mols.

When the processing solution with fixing capability is a bleach-fixer, it is preferable to use a ferric complex salt of aminocarboxylic acid or aminophosphonic acid as bleaching agent in the bleach-fixer. Said aminocarboxylic acid and aminophosphonic acid respectively mean an amino compound having at least 2 carboxyl groups and an amino compound having at least 2 phosphon groups; they are preferably represented by the following Formulae XII and XIII, respectively.

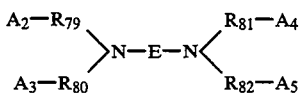

Formula XII

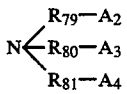

Formula XIII

In the above Formulae, E represents a substituted or unsubstituted alkylene group, cycloalkylene group, phenylene group, $—R_{83}OR_{83}OR_{83}—$, or $—R_{83}ZR_{83}-$; Z represents $N—R_{83}—A_6$ or $N—A_6$; $R_{79}$ through $R_{83}$ independently represent a substituted or unsubstituted alkylene group; $A_2$ through $A_6$independently represent a hydrogen atom —OH, —COOM, or $—PO_3M_2$; M represents a hydrogen atom or alkali metal atom.

Examples of preferred compounds of Formulae XII and XIII are given below.

EXAMPLE COMPOUNDS (XII-1) Ethylenediaminetetraacetic acid
(XII-2) Diethylenetriaminepentaacetic acid
(XII-3) Ethylenediamine-N-(β-hydroxyethyl)-N,N',N'-triacetic acid
(XII-4) 1,3-propylenediaminetetraacetic acid
(XII-5) Triethylenetetraaminehexaacetic acid
(XII-6) Cyclohexanediaminetetraacetic acid
(XII-7) 1,2-diaminopropanetetraacetic acid
(XII-8) 1,3-diaminopropan-2-ol-tetraacetic acid
(XII-9) Ethyl ether diaminetraacetic acid
(XII-10) Glycol ether diaminetetraacetic acid
(XII-11) Ethylenediaminetetrapropionic acid
(XII-12) Phenylenediaminetetraacetic acid
(XII-13) Disodium ethylenediaminetetraacetate
(XII-14) Tetratrimethylammonium ethylenediaminetetraacetate
(XII-15) Tetrasodium ethylenediaminetetraacetate
(XII-16) Pentasodium diethylenetriaminepentaacetate
Sodium ethylenediamine-N-(β-hydroxyethyl)-N,N',N'-triacetate
(XII-18) Sodium propylenediaminetetraacetate
(XII-19) Ethylenediaminetetramethylenephosphonic acid
(XII-20) Sodium cyclohexanediaminetetraacetate
(XII-21) Diethylenetr iaminepentamethylenephosphonic acid
(XII-22) Cyclohexanediaminetetramethylenephosphonic acid
(XIII-1) Nitrilotriacetic acid
(XIII-2) Methyliminodiacetic acid
(XIII-3) Hydroxyethyliminodiacetic acid
(XIII-4) Nitrilotripropionic acid
(XIII-5) Nitrilotrimethylenephosphonic acid
(XIII-6) Iminodimethylenephosphonic acid
(XIII-7) Hydroxyethyliminodimethylenephosphonic acid
(XIII-8) Trisodium nitrilotriacetate Of these aminocarboxylic acids and aminophosphonic acids, XII-1, XII-2, XII-4, XII-6, XII-7, XII-10, XII-19, XIII-1, and XIII-5 are especially preferable for the desired effect of the present invention; particularly, XII-4 is still more preferable.

The above-mentioned ferric complex salts of organic acids of the present invention are used in the form of free acids, alkali metal salts such as sodium salts, potassium salts and lithium salts, ammonium salts, or water-soluble amine salts such as triethanolamine salts; potassium salts, sodium salts, and ammonium salts are preferably used. These ferric complex salts may be used singly or in combination. Any amount of use may be chosen according to the silver content, silver halide composition etc. of the light-sensitive material to be processed; for example, these salts can be used at more than 0.01 mol per 1 bleach-fixer, preferably 0.05 to 1.0 mol. When these salts are used in replenishers, it is desirable to use them at the upper limit of solubility to minimize the amount of replenishment.

In the present invention, air or oxygen blowing may be conducted in the processing bath and replenisher storage tank, or a suitable oxidizing agent, such as hydrogen peroxide, bromate or persulfate may be added to increase bleacher or bleach-fixer activities.

In the method of the present invention, silver may be recovered from the fixer or bleach-fixer by a known method. Examples of methods which serve well for this purpose include the electrolysis method of French Patent No. 2,299,667, precipitation method of Japanese Patent Publication Open to Public Inspection No. 73037/1977, West German Patent No. 2,311,220, ion exchange method of Japanese Patent Publication Open to Public Inspection No. 17114/1976, West Germany Patent No. 2,548,237 and metal replacement method of British Patent No. 1,353,805.

In-line silver recovery from the tank solution is preferable, since rapid processing is facilitated, but silver may be recovered from overflow waste liquid and then regenerated.

The desired effect of the invention is enhanced when the fixer or bleach-fixer of the invention is replenished at less than 800 ml per $m^2$ light-sensitive material; a noticeable effect is obtained at 20 to 650 ml, particularly 30 to 400 ml per $m^2$ light-sensitive material.

The effect of the present invention is further enhanced when the fixer or bleach-fixer contains 0.1 to 1.0 g/l of iodide (e.g. ammonium iodide, potassium iodide, sodium iodide, lithium iodide) and/or thiocyanate (e.g.

sodium thiocyanate, potassium thiocyanate, ammonium thiocyanate). For better results, it is preferable to use these compounds at 0.3 to 5 g/l, more preferably 0.5 to 3 g/l, and most preferably 0.8 to 2 g/l.

It is preferable to use the fixer and bleach-fixer at pH 4 to 8, more preferably 5 to 7.5.

The fixer and bleach-fixer of the present invention may contain sulfites and sulfite-releasing compounds; examples of the sulfite and the sulfite-releasing compounds include potassium sulfite, sodium sulfite, ammonium sulfite, ammonium hydrogensulfite, potassium hydrogensulfite, sodium hydrogensulfite, potassium metabisulfite, sodium metabisulfite, and ammonium metabisulfite, and the compounds represented by the following Formula S-1 or S-2 are also included.

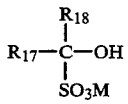
Formula S-1

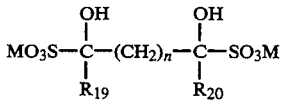
Formula S-2

In these Formulae, $R_{17}$ represents a hydrogen atom or alkyl group having 1 to 5 carbon atoms; $R_{18}$ represents an alkyl group having 1 to 5 carbon atoms which includes substituted ones; M represent an alkalimetal atom; $R_{19}$ and $R_{20}$ independently represent a hydrogen atom or alkyl group having 1 to 5 carbon atoms which includes substituted ones; n represents the integer 0 to 4.

Examples of the compounds of the above Formulae are given below, but the present invention is not limited by these examples.

Preferable compounds of Formulae S-1 and S-2 are exemplified below.

(S-1) Formaldehyde sodium bisulfite
(S-2) Acetaldehyde sodium bisulfite
(S-3) Propionaldehyde sodium bisulfite
(S-4) Butylaldehyde sodium bisulfite
(S-5) Succinic aldehyde sodium bisulfite
(S-6) Glutaraldehyde sodium bisbisulfite
(S-7) β-methylglutaraldehyde sodium bisbisulfite
(S-8) Maleic dialdehyde sodium bisbisulfite It is preferable to use these bisulfites and bisulfite-releasing compounds at ratios of at least 0.1 mol, as calculated as sulfite, per 1 fixer or bleach-fixer, preferably 0.12 to 0.65 mol/l, more preferably 0.15 to 0.50 mol/l, still more preferably 0.20 to 0.40 mol/l. The above-given mol numbers of sulfite of sulfite-releasing compound is mentioned in terms of mol numbers of sulfite.

It is preferable that total processing time for the bleaching solution and the solution with fixing capability, such as fixer or bleach-fixer, of the present invention be not more than 3 min 45 sec, more preferably 20 sec to 3 min 20 sec, still more preferably 40 sec to 3 min, most preferably 60 sec to 2 min 40 sec for the desired effect of the invention.

Bleaching time can be arbitrarily chosen in the above range of total time; for the desired purpose of the invention, it is preferable that bleaching time be not more than 1 min 30 sec, more preferably 10 to 70 sec, still more preferably 20 to 55 sec. Processing time for the processing solution with fixing capability can be arbitrarily chosen in the above range of total time; it is preferable that the processing time be not more than 3 min 10 sec, more preferably 10 sec to 2 min 40 sec, still more preferably 20 sec to 2 min 10 sec.

In the processing method of the present invention, it is preferable to conduct forced agitation of the bleaching solution, fixer and bleach-fixer. This is not only because the desired effect of the invention is enhanced but also because rapid processing is facilitated.

Such forced agitation is described in Japanese Patent Application No. 63-46919/1988, specification pp. 64–68.

Examples of preferred procedures of the processing method of the present invention are given below, but the invention is not limited thereby.

(1) Color developing→bleaching→fixing→washing
(2) Color developing→bleaching→fixing→washing→stabilization
(3) Color developing→bleaching→fixing→stabilization
(4) Color developing→bleaching→fixing→1st stabilization→2nd stabilization
(5) Color developing→bleaching→bleach-fixing→washing
(6) Color developing→bleaching→bleach-fixing→washing →stabilization
(7) Color developing→bleaching→bleach-fixing→stabilization
(8) Color developing→bleaching→bleach-fixing→1st stabilization→2nd stabilization, subsequent 3rd stabilization, if needed Of these procedures, (3), (4), (7) and (8) are preferable; particularly, (3) and (4) are more preferable.

Another preferred mode of the processing method of the invention is that in which partial or entire portion of overflow liquid of th color developer is flown into the bleacher; sludge formation in the bleacher is reduced when a given amount of the color developer is flown into the bleacher.

The color developer relating the present invention may contain alkali agents usually used in developers, e.g. sodium hydroxide, optassium hydroxide, ammonium hydroxide, sodium carbonate, potassium carbonate, sodium sulfate, sodium metaborate and borax, and may also contain various additives such as benzyl alcohol; alkali metal halides such as potassium bromide, potassium chloride; developing regulating agents such as citrazinic acid and preservatives such as hydroxylamine and sulfites.

Various defoaming agents, surfactants, and organic solvents such as methanol, dimethylformamide and dimethylsulfoxide may be contained as appropriate.

The developer relating the present invention usually has a pH of over 7, preferably about 9 to 13.

Also, the color developer used for the present invention may contain antioxidants such as hydroxylamine, tetronic acid, tetronimide, 2-anilinoethanol, dihydroxyacetone, aromatic secondary alcohol, hydroxamic acid, pentose or hexose, and pyrogallol-1,3-dimethylether.

In the color developer relating the present invention, various chelating agents may be used in combination as sequestering agents. Examples of such chelating agents include aminopolycarboxylic acids such as ethylenediaminetetraacetic acid and diethylenetriaminepentaacetic acid; organic phosphonic acids such as 1-hydroxyethylidene-1,1-diphosphonic acid; aminopolyphosphonic acids such as aminotri (methylenephosphonic acid) and ethylenediaminetetraphosphoric acid; oxycarbocylic acids such as citric acid and gluconic acid; phosphonocarboxylic acids such as 2-phosphonobutane- 1,2,4-tricarboxylic acid; and polyphosphoric acids such as tripolyphosphoric acid and hexametaphosphoric acid.

It is preferable that the color developer used in the present invention contain a color developing agent at a concentration of not less than $1.5\times10^{-2}$ mol/l, more preferably not less than $2.0\times10^{-2}$ mol/l.

In the present invention, the desired effect is especially enhanced when processing with a stabilizer is conducted after processing with a fixer or bleach-fixer.

The amount of stabilizer replenisher is 1 to 80 times, preferably 2 to 60 times the amount of solution transferred from the preceding bath per unit area of the color photographic light-sensitive material for picture taking; it is preferable that the preceding bath component, namely bleach-fixer or fixer, concentration of the stabilizer by less than 1/500, more preferably less than 1/1000 in the final chamber of the stabilizer tank. From the viewpoint of reduction of environmental pollution and lengthening storage life of the solution, it is preferable to compose the stabilization tank so that the concentration is 1/500 to 1/100000, more preferably 1/2000 to 1/50000.

It is preferable that the stabilization tank be composed of more than one chambers, more preferably 2 to 6 chambers.

From the viewpoint of the desired effect of the invention, particularly reduction of environmental pollution, it is preferable to provide 2 to 6 chambers for the stabilization tank and use the counter current method in which the solution is supplied to the posterion bath and overflown the solution from the preceding bath. It is especially preferable that the tank be composed of 2 or 3 chambers, more preferably 2 chambers.

The flow-in amount varies with the type of light-sensitive material, transport rate and method, and light-sensitive material surface squeezing method of automatic developing machine; in the case of color light-sensitive materials for picture taking or ordinary color roll films, the flow-in amount is usually 50 to 150 ml/m$^2$; the effect of the present invention becomes more noticeable under this condition when the amount of replenisher is 50 ml to 4.0 l/m$^2$, and it becomes still more noticeable when the amount of replenisher is 200 to 1500 ml/m$^2$.

Treatment temperature with the stabilizer is 15° to 60° C., preferably 20° to 45° C.

The stabilizer of the present invention may contain various chelating agents, described in detail in the specification for Japanese Patent Application 63-46919/1988 by the present applicant, pp. 73–82.

For the desired effect of the present invention and improved image storage life, it is preferable that the stabilizer preferably used for the invention have a pH value of 4.0 to 9.0, more preferably 4.5 to 9.0, still more preferably 5.0 to 8.5.

Any generally known alkali or acid can be used as pH adjuster in stabilizers preferably used for the present invention.

Stabilizers preferably used for the present invention may be added with salts of organic acids, e.g. citric acid, acetic acid, succinic acid, oxalic acid, benzoic acid; pH adjusters, e.g. phosphates, borates, hydrochloric acid, sulfates; surfactants;; preservatives; and salts of metals such as Bi, Mg, Zn, Ni, Al, Sn, Ti, and Zr. These substances may be used in any combination in any amount, as long as the stabilizing bath relating the present invention is kept at constant pH and neither stability of color photographic images nor precipitation during storage is not adversely affected.

The fungicides preferably used in stabilizers relating the present invention are hydroxybenzoic acid esters, phenol compounds, thiazole compounds, pyridine compounds, guanidine compounds, carbamate compounds, morpholine compounds, quaternary phosphonium compounds, ammonium compounds, urea compounds, isoxazole compounds, propanolamine compounds, sulfamide compounds, amino acid compounds, active halogen-releasing compounds, and benztriazole compounds.

These fungicides are described in detail in the specification for Japanese Patent Application 63-46919/1988 by the present applicant, pp. 84–90.

In the processing method of the present invention, silver may be recovered from the stabilizer as well by a method for silver recovery from fixer and bleach-fixer.

The stabilizer relating the present invention may be subjected to ion exchange resin contact, electrodialysis (cf. Japanese Patent Application No. 96352/1984), reverse osmosis (cf. Japanese Patent Application No. 96532/1984) etc.

It is preferable to use deionized water for the stabilizer relating the present invention, since the antifungal property, stability and image storage property of the stabilizer are improved. Any means of deionization can be used, as long as the dielectric constant of treated water is below 50 μs/cm, or the Ca/Mg ion concentration is below 5 ppm; for example, treatment using ion exchange resin or reverse osmosis membrane is preferably used singly or in combination. Ion exchange resins and reverse osmosis membranes are described in detail in Kokai-giho No. 87-1984; it is preferable to use strongly acidic H-type cation exchange resin and strongly alkaline OH-type anion exchange resin in combination.

For enhanced washing effect, improved whiteness, and antifungal property, it is preferable that the salt concentration of the stabilizer be below 1000 ppm, more preferably below 800 ppm.

For the effect of the present invention, processing time for the stabilizer is not more than 1 min, preferably not more than 1 min 30 sec, more preferably not more than 1 min.

In the processing method of the present invention, there is no particular limitation on the halogen composition of light-sensitive material, but is preferable that the average silver iodide content of the entire silver halide emulsion be 0.1 to 15 mol %, more preferably 0.5 to 12 mol %, still more preferably 3 to 10 mol %.

Also, there is no limitation on the average grain size of the entire silver halide emulsion in the light-sensitive material, but it is preferable that the average grain size be not more than 2.0 μm, more preferably 0.1 to 1.0 μm, still more preferably 0.2 to 0.6 μm.

In the processing method of the present invention, there is a lower limit of the total dry thickness of all hydrophilic collid layers in the light-sensitive material, hereinafter referred to as the thickness of emulsion side, depending on the silver halide emulsion, couplers, oils, additives etc. contained in the layer; it is preferably that the thickness of emulsion side be 10 to 50 μm, more preferably 15 to 30 μm.

It is also preferable that the distance between the uppermost surface of the emulsion side layer and the lowermost surface of the emulsion layer nearest the support be not less than 14 μm, and the distance between the uppermost surface and the lowermost surface of the emulsion layer which is different in color sensitivity from the emulsion layer nearest the support and which is second nearest the support be not less than 10 μm.

The light-sensitive material for the present invention is of the coupler-in-emulsion type (cf. U.S. Pat. Nos. 2,376,679 and 2,801,171), in which couplers are contained in the light-sensitive material; any coupler generally known in the relevant field can be used. Examples of cyan coupler include compounds having a naphthol or phenol structure as the base structure and which form indoaniline dye via coupling. Examples of magenta coupler include compounds having a 5-pyrazolone ring with active methylene group as the skeletal structure and pyrazoloazole compounds. Examples of yellow coupler include compounds having a benzoylacetoanilide, pivalylacetoanilide or acylacetoanilide structure with an active methylene ring. In these couplers, whether a substituent is contained at the coupling site. As stated above, both 2-equivalent and 4-equivalent couplers can be used.

The couplers preferably used to enhance the desired effect of the present invention are described in detail below.

The cyan couplers are represented by the following Formulae C-A, C-B, and C-C.

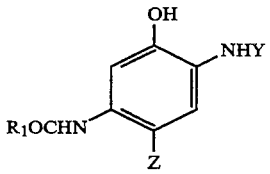

Formula C-A

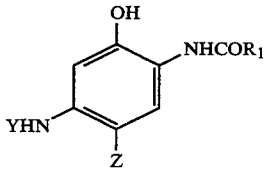

Formula C-B

In these Formulae, $R_1$ represents an alkyl group, alkenyl group, cycloalkyo group, aryl group or heterocyclic group; Y represents a group represented by

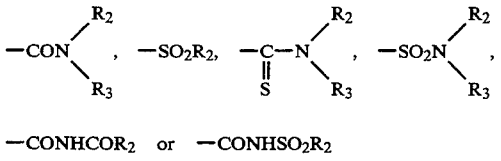

in which $R_2$ represents an alkyl group, alkenyl group, cycloalkyl group, aryl group or heterocyclic group; $R_3$ represents a hydrogen atom or group for $R_2$; $R_2$ and $R_3$ may be identical or not, and may link together to form a 5- to 6-membered heterocycle; Z represents a hydrogen atom or group capable of being split off by the coupling reaction with the oxidation product of the aromatic primary amine-type color developing agent.

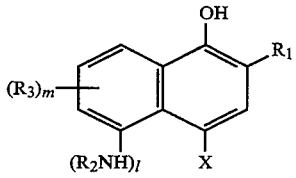

Formula C-C

Wherein $R_1$ represents —$COHR_4R_5$, —$NHCOR_4$, —$NHCOOR_6$, —$NHSO_2R_6$, —$HNCONR_4R_5$ or —$NHSO_2NR_4R_5$; $R_2$ represents a monovalent group; $R_3$ represents a substituent; X represents a hydrogen atom or group which capable of being split off by the reaction with the oxidation product of the aromatic primary amine-type color developing agent; 1 represents an integer 0 or 1; m represents an integer 0 to 3; $R_4$ and $R_5$ independently represent a hydrogen atom, aromatic group, aliphatic group or heterocyclic group; $R_6$ represents an aromatic group, aliphatic group or heterocyclic group; when m is 2 or 3, the $R_3$ units may be identical or not, and may link together to form a ring; $R_4$ and $R_5$, $R_2$ and $R_3$, $R_2$, and X may link together to form a ring; provided that when 1 is 0, m represents 0, $R_1$ represents —$CONHR_7$, and $R_7$ represents an aromatic group.

The above Formulae C-A and C-B are first described below. In these Formulae, Y represents a group

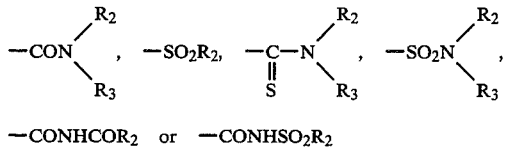

wherein $R_1$ and $R_2$ independently represent an alkyl group, preferably having 1 to 20 carbon atoms, e.g. methyl, ethyl, t-butyl, dodecyl; alkenyl group, preferably having 2 to 20 carbon atoms, e.g. aryl group, heptadecenyl group; cycloalkyl group; preferably 5- to 7-membered cycloalkyl group, e.g. cycloalkyl; aryl group, e.g. phenyl, tolyl, naphthyl; or heterocyclic group, preferably 5- or 6-membered heterocyclic group having 1 to 4 nitrogen, oxygen, or sulfur atoms, e.g. furyl, thienyl, benzothiazolyl. $R_3$ represents a hydrogen atom or group for $R_2$; $R_2$ and $R_3$ may link together to form a 5- or 6-membered heterocycle. Note that any substituent may be introduced to $R_1$ and $R_2$; examples of the substituent include alkyl groups having 1 to 10 carbon atoms, e.g. methyl, i-propyl, i-butyl, t-butyl, t-octyl; aryl groups, e.g. phenyl, naphthyl; halogen atoms, fluorine, chlorine, bormine etc.; cyano; nitro; sulfonamide groups, e.g. methanesulfonamide, butanesulfonamide, p-toluenesulfonamide; sulfamoyl groups, e.g. methylsulfamoyl, phenylsulfamoyl; sulfonyl groups, e.g. methanesulfonyl, p-toluenesulfonyl, fluorosulfonyl groups; carbamoyl groups, e.g. demethylcarbamoyl, phneylcarbamoyl; oxycarbonyl groups, e.g. ethoxycarbonyl, phenoxycarbonyl; acyl groups, e.g. acetyl, benzoyl; heterocyclic groups, e.g. pyridyl group, pyrazolyl group; alkoxy groups; aryloxy groups; and acyloxy groups.

In Formulae C-A and C-B, $R_1$ represents a balast groups essential to provide a nondiffusion property for the cyan couplers of these Formulae and cyan dyes formed therefrom, preferably an alkyl group having 4 to 30 carbon atoms, aryl group, alkeny group, cycloalkyl group or heterocyclic group; examples include normal or branched alkyl groups such as groups of t-butyl, n-octyl, t-octyl, n-dodecyl, and 5- or 6-membered heterocyclid rings.

In the above Formulae C-A and C-B, Z represents a hydrogen atom or group capable of being split off upon the coupling reaction with the oxidation product of N-hydroxyalkyl-substituted p-phenylenediamine derivative-type color developing agent. Examples include halogen atoms, e.g. chlorine, bromine, fluorine, substituted or unsubstituted alkoxy groups, aryloxy groups, heterocyclic oxy groups, acylocy groups, carbamoyloxy groups, sulfonyloxy groups, alkylthio groups, arylthio groups, heterocyclic thio groups, and sulfonamide groups; more specific examples include groups described in U.S. Pat. No. 3,741,563, Japanese Patent Examine Publication No. 48-36894/1973, Japanese Patent Publication Open to Public Inspection Nos. 47-37425/1972, 50-10135/1975, 50-117422/1975, 50-13044/1975, 51-108841/1976, 50-120343/1975, 52-18315/1977, 53-105226/1978, 54-14736/1979, 54-48237/1979, 55-32071/1980, 55-65957/1980, 56-1938/1981, 56-12643/1981, 56-27147/1981, 59-146050/1984, 59-166956/1984, 60-24547/1985, 60-35731/1985, and 60-37557/1985. The cyan couplers represented by Formula C-D are preferable for the present invention.

Formula C-D

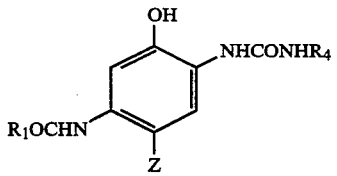

Wherein $R_4$ represents a substituted or unsubstituted aryl group, preferably a phenyl group. The substituent for the aryl group includes $—SO_2R_5$, halogen atoms such as fluorine, chlorine, bromine; $—CF_3$, $—NO_2$, —CN, $—COR_5$, $—COOR_5$, $—SO_2OR_5$,

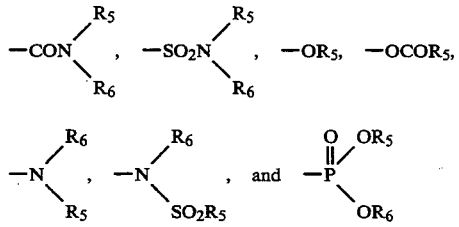

Wherein $R_5$ represents an alkyl group, preferably having 1 to 20 carbon atoms, e.g. methyl, ethyl, t-butyl, dodecyl; alkenyl group, preferably having 2 to 20 carbon atoms, e.g. allyl group, heptadecenyl group; cycloalkyl group, preferably having 5- to 7-member, e.g. cyclohexyl group; or aryl groups, e.g. phenyl group, tolyl group, naphthyl group; $R_6$ represents a hydrogen atom or group for $R_5$.

The compounds of Formula C-D preferred for cyan couplers for the present invention have a substituted or unsubstituted phenyl group for $R_4$, and the substituent in the phenyl group is cyano, nitro, $—SO_2R_7$, $R_7$represents an alkyl group, halogen atom, or trifluoromethyl.

In Formula C-D, Z and $R_1$ each have the same definition as in Formulae C-A and C-B. The balast groups preferable for $R_1$ are represented by the following Formula C-E.

Formula C-E

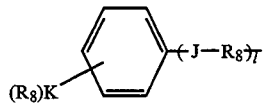

Wherein J represents an oxygen atom, sulfur atom or sulfonyl group; k represents the integer 0 to 4; 1 represents 0 or 1; when k is 2 or more, the $R_9$ units may be identical or not; $R_8$ represents a normal or branched alkylene group having 1 to 20 carbon atoms which may have aryl group etc. as a substituent; $R_9$ represents a monovalent group, preferably a hydrogen atom, halogen atom, e.g. chlorine, bromide; alkyl group, preferably a normal or branched alkyl group having 1 to 20 carbon atoms, e.g. methyl, t-butyl, t-pentyl, t-octyl, dodecyl, pentadecyl, benzyl, phenetyl; aryl group, e.g. phenyl group; heterocyclic group, e.g. nitrogen-containing heterocyclic group; alkocy group, preferably normal or branched alkoxy group having 1 to 20 carbon atoms, e.g. methoxy, ethyoxy, t-butyloxy, octyloxy, decyloxy, dodecyloxy; aryloxy group, e.g. phenoxy group; hydroxy group; acyloxy group; preferably alkylcarbonyloxy group, arylcarbonyloxy group, e.g. acetoxy group, benzoloxy group; carboxyl alkyloxycarbonyl group, normal or branched alkylcarbonyl group preferably having 1 to 20 carbon atoms, preferably phenoxycarbonyl group; alkylthio group; acyl group preferably having 1 to 20 carbon atoms; acylamino group, normal or branched alkylcarbamide group preferably having 1 to 20 carbon atoms; benzenecarbamide group; sulfonamide group, preferably normal or branched alkylsulfonamide or benzenesulfonamide group having 1 to 20 carbon atoms; carbamoyl group; normal or branched alkylaminocarbonyl or phenylaminocarbonyl group preferably having 1 to 20 carbon atoms; sulfamoyl group; normal or branched alkylmainosulfonyl or phenylaminosulfonyl group preferably having 1 to 20 carbon atoms.

Examples of compounds represented by Formula C-A or C-B for cyan couplers for the present invention are given in Japanese Application No. 63-46919/1988.

Formula C-C is explained below.

The groups represented by $R_2$ through $R_7$ in Formula C-C each include substituted groups.

For $R_6$, aliphatic groups having 1 to 30 carbon atoms, aromatic groups having 1 to 30 carbon atoms, and heterocyclic groups having 1 to 30 carbon atoms are preferable; for $R_4$ and $R_5$, hydrogen atom and the groups preferable for $R_6$ are preferred.

For $R_2$, is preferable a hydrogen atom bound to NH directly via NH, CO or $SO_2$, aliphatic group having 1 to 30 carbon atoms, aromatic group having 6 to 30 carbon atoms, heterocyclic group having 1 to 30 carbon atoms, $—OR_8$, $—COR_8$,

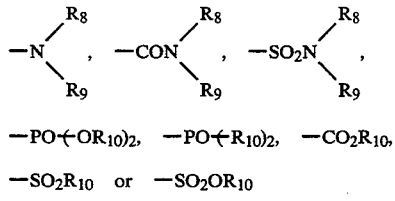

in which $R_8$, $R_9$ and $R_{10}$ each have the same definition as $R_4$, $R_5$ and $R_6$; $R_8$ and $R_9$ may link together to form a heterocycle.

$R_7$ preferably represents an aromatic group having 6 to 30 carbon atoms; typical examples of the substituent for $R_7$ include halogen atoms, hydroxy group, amino group, carboxyl group, sulfon group, cyano group, aromatic group, heterocyclic group, carbonamide group, sulfonamide group, carbamoyl group, sulfamoyl group, ureido group, acyl group, acyloxy group, aliphatic oxy group, aromatic oxy group, aliphatic thio group, aromatic thio group, aliphatic sulfonyl group, aromatic sulfonyl group, sulfamoylamino group, nitro group, imide group, sliphatic group, and aliphatic oxycarbonyl group. When $R_7$ is substituted by more than one substituent, the substituents may link together to form a ring, such as dioxamethylene group.

Typical examples of the group for $R_3$ include halogen atom, hydroxy group, amino group, carboxyl group, sulfon group, cyano group, aromatic group, heterocyclic group, carbonamide group, sulfonamide group, carbamoyl group, sulfamoyl group, ureido group, acyl group, acyloxy group, aliphatic oxy group, aromatic oxy group, aliphatic thio group, aromatic thio group, aliphatic sulfonyl group, aromatic sulfonyl group, sulfamoylamino group, nitro group, and imide group. The number of carbon atoms contained in $R_3$ is preferably 0 to 30. When m=2, the cyclic group for $R_3$ is exemplified by dioxymethylene group.

When 1=1, $R_1$ preferably represents $—CONR_4R_5$, m preferably represents 0, $R_2$ preferably represents $—COR_8$, $—COOR_{10}$, $—SO_2R_{10}$, $—CONR_8R_9$, or $—SO_2NR_8R_9$ in direct bond to NH, more preferably $—COOR_{10}$, $—SOR_8$, or $—SO_2R_{10}$, most preferably $—COOR_{10}$.

Compounds which form a dimer or higher polymer via $R_1$through $R_3$ and X are also involved in the coupler usable for the present invention.

In Formula C-C, 1 preferably represents 0.

Examples of the coupler represented by Formula C-C are given in Japanese Patent Publication Open to Public Inspection Nos. 60-237448/1985, 61-153640/1986, 65-145557/1986, 62-85242/1987, 48-15529/1973, 50-117422/1975, 52-18315/1977, 52-90932/1977, 53-52423/1978, 54-48237/1979, 54-66129/1979, 55-32071/1980, 55-65957/1980, 55-105226/1980, 56-1938/1981, 56-12643/1981, 56-27147/1981, and 58-95346/1983, and U.S. Pat. No. 3,488,193; these couplers can be synthesized by the methods described in these references.

In adding a coupler to a light-sensitive material, various methods can be used according to coupler properties such as solubility, for example, the oil-in-water emulsifying dispersion method, using water-insoluble high boiling point organic solvent, the alkali dispersion method, in which the coupler is added in alkaline solution, the latex dispersion method, and the solid dispersion method, in which the coupler is directly added in a fine solid.

These couplers are normally added at $1.0\times10^{-3}$ to 1.0 mol per mol silver halide, preferably $5.0\times10^{-3}$ to $8.0\times10^{-1}$.

Typical examples of the coupler of Formula C-C include the examples given in Japanese Patent Application No. 63-46919/1988, pp. 124–142.

The cyan coupler is normally used at $1\times10^{-3}$ to 1 mol per mol silver halide, preferably $5\times10^{-3}$ to $1\text{–}8\times10^{31\ 1}$ mol.

For enhancing the desired effect of the invention, it is preferable that at least one of the photographic structural layers for the light-sensitive material processed by the method of the invention, particularly at least one of the green-sensitive emulsion layers, contain a magenta coupler represented by the following Formula M-1.

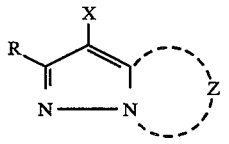

Formula M-1

Wherein Z represents a nonmetal atom necessary to the formation of a nitrogen-containing heterocyclic ring, which may have a substituent; X represents a hydrogen atom or group capable being split off upon the reaction with the oxidation product of the color developing agent; R represents a hydrogen atom or substituent.

In Formula M-1, there in no particular limitation on the choice of the substituent for R; typical examples include alkyl, aryl, anilino, acylamino, sulfonamido, alkylthio, arylthio, alkenyl and cycloalkyl groups; are also included halogen atoms, cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, and heterocyclic thio groups, as well as spiro compound residues and bridged hydrocarbon residues.

The alkyl group for R preferably has 1 to 32 carbon atoms, and may be normal or branched.

The aryl group for R is preferably a phenyl group.

The acylamino group for R includes alkylcarbonylamino group and arylcarbonylamino group.

The sulfonamido group for R include alkylsulfonylamino group and arylsulfonylamino groups.

The alkyl and aryl moieties of the alkylthio group and arylthio group for R include the above-mentioned alkyl groups and aryl groups for R.

The alkenyl group for R preferably has 2 to 32 carbon atoms, and the cycloalkyl group preferably has 3 to 12 carbon atoms, more preferably 5 to 7 carbon atoms; the alkenyl group may be normal or branched.

The cycloalkenyl group for R preferably has 3 to 12 carbon atoms, particularly 5 to 7 carbon atoms.

Examples of the sulfonyl group for R include alkylsulfonyl groups and arylsulfonyl groups; examples of the sulfinyl group include alkylsufinyl groups and arylsulfinyl groups; examples of the phosphonyl group include alkylphosphonyl groups and arylphosphonyl groups; examples of the acyl group include alkylcarboxy groups and arylcarboxy groups; examples of the carbamoyl group include alkylcarbamoyl groups and arylcarbamoyl groups; examples of the sulfamoyl group include alkylsulfamoyl groups and arylsulfamoyl groups; examples of the acyloxy group include alkylcarbonyloxy groups and arylcarbonyloxy groups; examples of the carbamoyloxy group include alkylcarbamoyloxy groups and arylcarbamoyloxy groups; examples of the ureido group include alkyureido groups and arylureido groups; examples of the sulfamoyl amino group include alkylsulfamoylamino groups and arylsulfamoylamino groups; examples of the heterocyclic group include preferably 5- to 7-membered heterocyclic groups such as 2-furyl, 2-thienyl, 2-pyrimidinyl and 2-benzothiazolyl groups; examples of the heterocylic oxy group include those preferably having a 5- to 7-membered heterocycle, such as 3,4,5,6-tetrahydropiranyl-2-oxy and 1-phenyltetrazol-5-oxy groups; examples of the heterocyclic thio group include preferably 5- to 7-membered heterocyclic thio groups such as 2-pyridylthio, 2-benzothiazolylthio, and 2,4-diphenoxy-l,3,5-triazole-6-thio groups; examples of the siloxy group include trimethylsiloxy, triethylsiloxy, and dimethylbutylsiloxy groups; examples of the imido group include succinimide, 3-heptadecylsuccinimido, phthalimido and glutarimido groups; examples of the spiro compound residue include spiro[3.3]heptane-1-yl; and examples of the bridged hydrocarbon residue include bicyclo[2.2.1-]heptan-1-yl, tricyclo[3.3.1.1$^{3,7}$]decan-1-yl and 7,7-dimethyl-bicyclo[2.2.7]heptan-1-yl.

Examples of the group for X capable of being split off upon the reaction with the oxidation product of the color developing agent include halogen atoms such as chlorine, bromine, fluorine and groups such as alkoxy, aryloxy, heterocyclic oxy, acyloxy, sulfonyloxy, alkoxyxarbonyloxy, aryloxycarbonyl, alkyloxalyloxy, alkyloxyoxalyloxy, alkylthio, arylthio, heterocyclic thio, alkyloxycarbonylthio, acylamino, sulfonamido, nitrogen-containing heterocycle bonded through N atom, alkyloxycarbonylthiamino, aryloxycarbonylamino, carboxyl, and

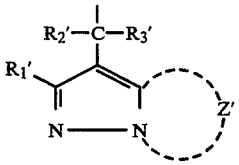

wherein $R_1'$ has the same definition as R above; Z' has the same definition as Z above; $R_2'$ and $R_3'$ independently represent a hydrogen atom, aryl group, alkyl group or heterocyclic group, a halogen atom, particularly chlorine atom is preferable.

Examples of the nitrogen-containing heterocycle formed by Z to Z' include pyrazole rings, imidazole rings, triazole rings, and tetrazole rings; examples of the substituent which these rings may have include those mentioned for R above.

The compound represented by Formula M-I is more specifically exemplified by the compounds of the following Formulae M-II through M-VII.

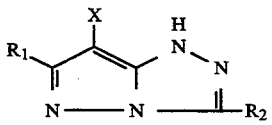

Formula [M-II]

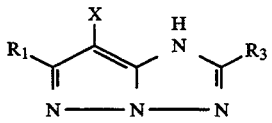

Formula [M-III]

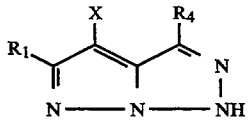

Formula [M-IV]

-continued

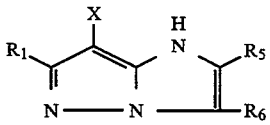

Formula [M-V]

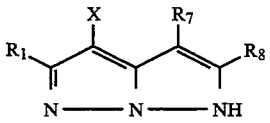

Formula [M-VI]

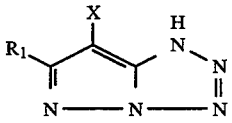

Formula [M-VII]

In the above Formulae M-II through M-VII, $R_2$ through $R_8$ and X have the same definitions as R above.

Of the compounds of Formula M-I, compounds represented by the following Formula M-VIII are preferable.

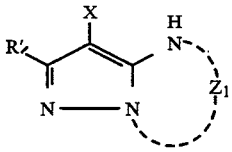

Formula M-VIII

Wherein $R_1$, X and $Z_1$ have the same definitions as $R_1$, X and Z in Formula M-I.

Of the magenta couplers represented by the above Formula M-II through V-VII, the magenta couplers represented by Formula M-II is especially preferable.

For the substituent which may be contained in the ring formed by Z in Formula M-I and ring formed by $Z_1$ in Formula M-VIII, and $R_2$ through $R_8$ in Formula M-II through M-VI, groups represented by Formula M-IX are preferable.

Formula M-IX $$-R^1-SO_2-R^2$$

Wherein $R^1$ represents an alkylene group; $R^2$ represents an alkyl group, cycloalkyl group or aryl group.

The alkylene group for $R^1$ preferably has 2 or more carbon atoms, more preferably 3 to 6 carbon atoms in the normal chain moiety, and it does not matter whether the group itself is normal or branched.

The alkyl group for $R^2$ preferably has 5 to 6 members.

In use to form positive images, the most preferable substituents for R and $R_1$ on the above-mentioned heterocycles are represented by the following Formula M-X.

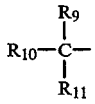

Formula M-X

Wherein $R_9$, $R_{10}$ and $R_{11}$ independently have the same definision as R above.

Also, two of $R_9$, $R_{10}$ and $R_{11}$, e.g. $R_9$ and $R_{10}$, may link together to form a saturated or unsaturated ring, e.g. cycloalkane, cycloalkene, heterocycle, which may further link with $R_{11}$ to form a bridged hydrocarbon residue.

As to Formula M-X, it is preferable that (i) at least two of $R_9$ through $R_{11}$ are alkyl groups, or (ii) at least one of $R_9$ through $R_{11}$, e.g. $R_{11}$, is a hydrogen atom, which links with the other groups $R_9$ and $R_{10}$ to form a cycloalkyl in cooperation with the root carbon atoms.

In the case of (i), it is preferable that two of $R_9$ through $R_{11}$ are alkyl groups and the other one is a hydrogen atom or alkyl group.

In use to form negative images, the most preferable substituents for R and $R_1$ on the above-mentioned heterocycles are represented by the following Formula M-X.

Formula X-XI $$R_{12}—CH_2—$$

Wherein $R_{12}$ has the same definition as R above.

For $R_{12}$, a hydrogen atom or alkyl group is preferable.

Representative examples of the magenta couplers preferably used for the present invention include the compounds 1 through 177 described in the specification for Japanese Patent Application No. 61-180310/1987, pp. 48–64, as well as compound Nos. 1–4, 6, 8–17, 19–24, 26–43, 45–59, 61–104, 106–121, 123–162 and 164–223 of the compounds described in the specification for Japanese Patent O.P.I. Publication No. 62-166339/1987.

The above-mentioned magenta couplers can be synthesized in accordance with the Journal of the Chemical Society, Perkin, I (1977), pp. 2047–2052, U.S. Pat. No. 3,725,067, Japanese Patent Publication Open to Public Inspection Nos. 59-99437/1984, 58-42045/1983, 59-162548/1984, 59-171956/1984, 60-33552/1985, 60-43659/1985, 60-172982/1985 and 60-190779/1985.

The above-mentioned magenta couplers are usually used at $1\times10^{-1}$ to 1 mol, preferably $1\times10^{-2}$ to $8\times10^{-1}$ mol per mol silver halide.

The magenta dye-forming couplers preferably used for the present invention are represented by the following Formula I

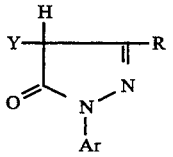

Formula I

Ar represents a phenyl group, sepcifically a substituted phenyl group.

The substituents are halogen atoms, alkyl groups, alkoxy groups, aryloxy groups, alkoxycarbonyl groups, cyano groups, carbamoyl groups, sulfamoyl groups, sulfonyl groups, sulfonamido groups, and acylamino groups; the phenyl group for Ar may have two or more substituents.

Examples of the substituent are given below.

Halogen atoms: chlorine, bromine, fluorine.

Alkyl groups: methyl group, ethyl group, isopropyl group, butyl group, t-butyl group, t-pentyl group etc.; particularly, alkyl groups having 1 to 5 carbon atoms are preferable.

Alkoxy groups:

Methoxy group, ethoxy group, butoxy group, sec-butoxy group, isopentyloxy group etc.; particularly alkoxy groups having 1 to 5 carbon atoms are preferable.

Aryloxy groups:

Phenoxy group, β-naphthoxy group etc.; the aryl moiety may have a substituent mentioned for the phenyl group for Ar above.

Alkoxycarbonyl groups:

Carbonyl groups with an alkyl group as mentioned above; alkoxycarbonyl groups having 1 to 5 carbon atoms in the alkyl moiety are preferable, e.g. methoxycarbonyl group and pentyloxycarbonyl group.

Carbamoyl groups:

Alkylcarbamoyl groups such as carbamoyl group and dimethylcarbamoyl group.

Sulfamoyl groups:

Alkylsulfamoyl groups such as sulfamoyl group, methylsulfamoyl group, dimethylsulfamoyl group and ethylsulfamoyl group.

Sulfonyl groups:

Alkylsulfonyl groups such as methanesulfonyl group, ethanesulfonyl group and butanesulfonyl group, and arylsulfamoyl groups.

Sulfonamido groups:

Alkylsulfonamido groups such as methanesulfonamido group and toluenesulfonamido group, and arylsulfonamido groups.

Acylamino groups:

Acetamido group, pivaloylamino group, benzamido group etc.

Among the above-mentioned groups, halogen atoms are preferable and chlorine atom is particularly preferable.

Y represents a group which is split when a dye is formed in coupling with the oxidation product of a p-phenylenediamine-type color developing agent.

Examples include halogen atoms, alkoxy groups, aryloxy groups, acyloxy groups, arylthio groups, alkylthio groups, and

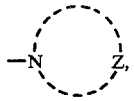

wherein Z represents an atomic group which cooperates with the nitrogen atom and atoms selected from carbon, oxygen, nitrogen and sulfur atoms to form a 5- or 6-membered ring.

Specific examples are given below.

Halogen atoms: Chlorine, bromine, fluorine.

Alkoxy groups:

Ethoxy group, benzyloxy group, methoxyethylcarbamoylmethoxy group, tetradecylcarbamoylmethoxy group etc.

Aryloxy groups:

Phenoxy group, 4-methoxyphenoxy group, 4-nitrophenoxy group etc.

Acyloxy groups:

Acetoxy group, myrystoyloxy group, benzyloxy group etc.

Arylthio groups:

Phenylthio group, 2-butoxy-5-octylphenylthio group, 2,5-dihexyloxyphenylthio group etc.

Alkylthio groups:

Methylthio group, octylthio group, hexadecylthio group, benzylthio group, 2-(diethylamino)ethylthio group, ethoxycarbonylmethylthio group, phenoxyethyl thio group etc.

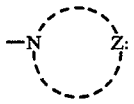

Pyrazolyl group, imidazolyl group, triazole group, tetrazolyl group etc.

R:

When R is an acylamino group, examples include acetamido group, isobutylamino group, benzamido group, 3-[α-(2,4-di-tert-amylphenoxy) butylamido]benzamido groups, 3-[α(2,4-di-tert-amylphenoxy) acetamido]benzamido group, 3-[α-(3-pentadecylphenoxy) butylamido]benzamido group, α-(2,4-di-tert-amylphenoxy) butylamido group, α-(3 -pentadecylphenoxy) butylamido group, hexadecaneamido group, isostearoylamino group, 3-(3-octadecenylsuccinimide) benzamido group and pivaloylamino group; when R is an anilino group, examples include anilino group, 2-chloroanilino group, 2,4-dichloroanilino group, 2,5-dichloroanilino group, 2,4,5-trichloroanilino group, 2-chloro-5-tetradecaneamidoanilino group, 2-chloro-5- (3-octadecenylsuccinimido) anilino group, 2-chloro-5-[α-(3-tert-butyl-4-hydroxy) tetradecaneamido]anilino group, 2-chloro-5-tetradecyloxycarbonylanilino group, 2-chloro-5- (N-tetradecylsulfamoyl) anilino groups, 2,4-dichloro-5-tetradecyloxyanilino group, 2-chloro-5- (tetradecyloxycarbonylamino) anilino group, 2-chloro-5-octadecylthioanilino group and 2-chloro-5- (N-tetradecylcarbamoyl) anilino group; when R is an ureido group, examples include 3-{(2,4-di-tert-aminophenoxy) acetamido}phenylureido group, phenylureido group, methylureido group, octadecylureido group, 3-tetradecanamidophenylureido group and N,N-dioctylureido group.

Of the compounds represented by Formula I the preferable compounds are represented by Formula II.

Formula II

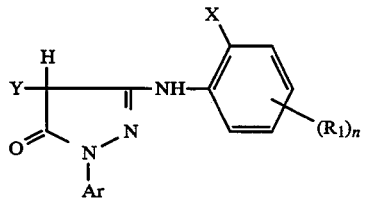

Wherein Y and Ar have the same definitions as in Formula I.

X represents a halogen atom, alkoxy group or alkyl group.

The halogen atom, alkoxy group and alkyl group for X are exemplified below.

Halogen atoms: Chlorine, bromine, fluorine.

Alkoxy groups:

Alkoxy groups having 1 to 5 carbon atoms are preferable, e.g. methoxy group, ethoxy group, butoxy group, sec-butoxy group, iso-pentyloxy group.

Alkyl groups:

Alkyl group having 1 to 5 carbon atoms are preferable, e.g. methyl group, ethyl group, isopropyl group, butyl group, t-butyl group, t-pentyl group.

Halogen atoms are especially preferable; chlorine is most preferable.

$R_1$ represents a group capable of bonding to a benzene ring as a substituent; n represents the integer 1 or 2; when n=2, the $R_1$ units may be identical or not.

Examples of the group for $R_1$ capable of bonding to a benzene ring as a substituent include halogen atoms and groups of

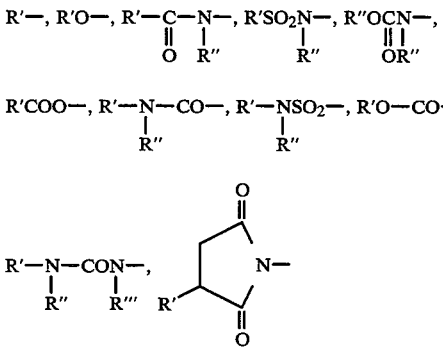

R', R'', and R''', whether identical or not, independently represent a hydrogen atom, or an alkyl, alkenyl or aryl group which may has a substituent. Of these groups, R'CONH—,

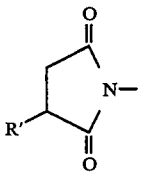

are preferable.

Examples of these magenta couplers preferably used for the present invention are given in the specification for Japanese Patent O.P.I. Publication No. 61-289530/1986, pp. 42–51 and the specification for Japanese Patent O.P.I. Publication No. 61-50145/1986, pp. 39–46. These couplers can easily be synthesized in accordance with the methods described in Japanese Patent O.P.I. Publication Nos. 56-38043/1981, 57-14837/1982, 57-204036/1982 and 58-14833/1983.

These magenta couplers are preferably added at ratios of 0.005 to 2 moles, more preferably 0.01 to 1 mol per mol silver halide.

The above-mentioned cyan couplers or magenta couplers may be used singly or in combination; it is also possible to use them in combination with one or more other cyan or magenta couplers.

When the light-sensitive material has two or more light-sensitive emulsion layers with different speeds one or more cyan or magenta couplers may be added to one or more of the emulsion layers. It is preferable that the silver halide emulsions applicable to the present invention be in the form of tabular grains, and any silver halide can be used, including silver chloride, silver bromide, silver iodide, silver chlorobromide, silver chloroiodide, silver iodobromide, and silver chloroiodobromide. As protective colloids for these silver halides, various substances can be used, as well as natural substances such as gelatin.

The silver halide emulsion may contain ordinary photographic additives, such as stabilizing agents, sensitizing agents, hardeners, sensitizing dyes and surfactants.

Color negative films, color paper, color reversal films, color reversal paper and other light-sensitive materials can be used for the present invention.

The present invention provides a processing method free of bleach fogging and a bleaching solution which functions well in embodying said processing method.

EXAMPLES

The present invention will be described in more detail by means of the following examples, but these are not to be construed as limitations on the present invention.

EXAMPLE 1

The amounts of additives to silver halide photographic light-sensitive material are shown in g per $m^2$; the amounts of silver halide and collodal silver are shown in terms of silver.

A multilayer color photographic light-sensitive material with high sensitivity comprising the following layers of the respective compositions was prepared on a cellulose triacetate film base.

| | |
|---|---|
| Layer 1: Antihalation layer | |
| Black colloidal silver | 0.2 |
| Gelatin | 1.7 |
| Ultraviolet absorber (UV-1) | 0.3 |
| Colored coupler (CM-1) | 0.2 |
| Solvent for ultraviolet absorber dispersion (oil-1) | 0.15 |
| Solvent for ultraviolet absorber dispersion (oil-2) | 0.15 |
| Solvent for colored coupler dispersion (oil-3) | 0.2 |
| Layer 2: Interlayer | |
| Gelatin | 1.2 |
| Layer 3: 1st red-sensitive emulsion layer | |
| Silver iodobromide emulsion (Em-1) | 1.0 |
| Silver iodobromide emulsion (Em-2) | 0.5 |
| Gelatin | 1.3 |
| Sensitizing dye (S-1) | $0.5 \times 10^{-4}$ (mol/mol silver) |
| Sensitizing dye (S-2) | $2 \times 10^{-4}$ (mol/mol silver) |
| Sensitizing dye (S-3) | $2 \times 10^{-4}$ (mol/mol silver) |
| Cyan coupler (C-1) | 0.07 |
| Cyan coupler (C-2) | 0.3 |
| Cyan coupler (C-4) | 0.3 |
| Colored cyan coupler (CC-1) | 0.07 |
| DIR compound (D-1) | 0.005 |
| Solvent for (C-1) (C-2) (C-4) (CC-1) and (D-1) (oil-1) | 0.2 |
| Layer 4: Interlayer | |
| Gelatin | 0.8 |
| Layer 5: 1st green-sensitive emulsion layer | |
| Silver iodobromide emulsion (Em-1) | 1.0 |
| Silver iodobromide emulsion (Em-2) | 0.5 |
| Gelatin | 1.4 |
| Sensitizing dye (S-4) | $1.8 \times 10^{-4}$ (mol/mol silver) |
| Sensitizing dye (S-5) | $1.3 \times 10^{-4}$ (mol/mol silver) |
| Sensitizing dye (S-6) | 9.2 × 10-5 (mol/mol silver) |
| Sensitizing dye (S-7) | 6.8 × 10-5 (mol/mol silver) |
| Sensitizing dye (S-8) | $6.2 \times 10^{-4}$ (mol/mol silver) |
| Magenta coupler (M-1) | 0.15 |
| Colored magenta coupler (CM-1) | 0.08 |
| Solvent for (M-1), (CM-1) dispersion (oil-3) | 0.23 |
| Layer 6: Interlayer | |

-continued

| | |
|---|---|
| Gelatin | 0.8 |
| Anti-stain agent (SC-1) | 0.05 |
| Solvent for (SC-1) dispersion (oil-3) | 0.05 |
| Layer 7: 1st blue-sensitive emulsion layer | |
| Silver iodobromide emulsion (Em-1) | 0.8 |
| Gelatin | 0.6 |
| Sensitizing dye (S-9) | $3 \times 10^{-4}$ (mol/mol silver) |
| Sensitizing dye (S-10) | $1 \times 10^{-4}$ (mol/mol silver) |
| Yellow coupler (Y-1) | 0.3 |
| Solvent for (Y-1) dispersion (oil-3) | 0.3 |
| Layer 8: Interlayer | |
| Gelatin | 0.8 |
| Anti-stain agent (SC-1) | 0.05 |
| Solvent for (SC-1) dispersion (oil-3) | 0.05 |
| Layer 9: 2nd red-sensitive emulsion layer | |
| Silver iodobromide emulsion (Em-1) | 1.0 |
| Silver iodobromide emulsion (Em-3) | 2.0 |
| Fine-grain AgX emulsion (average grain size, 0.08 μm, silver iodobromide of AgI = 1 mol %) | 0.5 |
| Gelatin | 2.4 |
| Sensitizing dye (S-1) | $0.2 \times 10^{-4}$ (mol/mol silver) |
| Sensitizing dye (S-2) | $1.0 \times 10^{-4}$ (mol/mol silver) |
| Cyan coupler (C-1) | 0.2 |
| Cyan coupler (C-3) | 0.05 |
| Cyan coupler (C-4) | 0.10 |
| Anti-stain agent (SC-1) | 0.05 |
| Solvent for (C-1), (C-3), (C-4), (SC-1) dispersion (oil-1) | 0.4 |
| Layer 10: Interlayer | |
| Gelatin | 0.8 |
| Anti-stain agent (SC-1) | 0.07 |
| Colored magenta coupler (CM-1) | 0.04 |
| Solvent for (SC-1), (CM-1), dispersion (oil-3) | 0.25 |
| Layer 11: 2nd green-sensitive emulsion layer | |
| Silver iodobromide emulsion (Em-1) | 0.8 |
| Silver iodobromide emulsion (Em-3) | 1.6 |
| Gelatin | 1.6 |
| Sensitizing dye (S-4) | $6.8 \times 10^{-5}$ (mol/mol silver) |
| Sensitizing dye (S-5) | $6.7 \times 10^{-5}$ (mol/mol silver) |
| Sensitizing dye (S-6) | $2.1 \times 10^{-6}$ (mol/mol silver) |
| Magenata coupler (M-1) | 0.2 |
| Colored magenta coupler (CM-1) | 0.02 |
| Solvent for (M-1), (CM-1), dispersion (oil-4) | 0.2 |
| Layer 12: Interlayer | |
| Fine-grain AgX emulsion (average grain size, 0.08 μm, silver iodobromide of AgI = 2 mol %) | 0.3 |
| Gelatin | 0.8 |
| Anti-stain agent (SC-1) | 0.05 |
| Solvent for (SC-1) dispersion (oil-3) | 0.05 |
| Layer 13: 2nd blue-sensitive emulsion layer | |
| Silver iodobromide emulsion (Em-1) | 0.7 |
| Silver iodobromide emulsion (Em-4) | 1.4 |
| Fine-grain AgX emulsion (average grain size, 0.08 μm, silver iodobromide of AgI = 2 mol %) | 0.1 |
| Fine-grain AgX emulsion (average grain size, 0.03 μm, silver iodobromide of AgI = 2 mol %) | 0.1 |
| Gelatin | 2.1 |
| Sensitizing dye (S-10) | $0.4 \times 10^{-4}$ (mol/mol silver) |
| Sensitizing dye (S-11) | $1.2 \times 10^{-4}$ (mol/mol silver) |
| Yellow coupler (Y-1) | 0.8 |
| Solvent for (Y-1) dispersion (oil-3) | 0.8 |
| Layer 14: 1st protective layer | |
| Gelatin | 1.5 |

-continued

| | |
|---|---|
| Ultraviolet absorber (UV-1) | 0.1 |
| Ultraviolet absorber (UV-2) | 0.1 |
| Formalin scavenger (HS-1) | 0.5 |
| Formalin scavenger (HS-2) | 0.2 |
| Solvent for ultraviolet absorber dispersion (oil-1) | 0.1 |
| Solvent for ultraviolet absorber dispersion (oil-2) | 0.1 |
| Layer 15: 2nd protective layer | |
| Gelatin | 0.6 |
| Alkali-soluble matting agent (average grain size, 2 μm) | 0.12 |
| Polymethyl methacrylate (average grain size, 3 μm) | 0.02 |
| Lubricant (WAX-1) | 0.04 |
| Antistatic agent (W-1) | 0.004 |

Note that the coating aid Su-1, dispersion aids Su-2 and Su-3, hardeners H-1 and H-2, stabilizer ST-1, and antifogging agents AF-1 and AF-2 were also added to each layer.

Em-1

Monodisperse type emulsion having a relatively low silver iodide content in the surfacial portion of the silver halide grains with an average grain size of 0.8 μm and an average silver iodide content of 8.0%.

Em-2

Monodispersed type emulsion having a relatively low silver iodide content in the surfacial portion of the silver halide grains, with an average grain size of 0.4 μm and an average silver iodide content of 7.0%.

Em-3

Monodispersed type emulsion having a relatively low silver iodide content in the surfacial portion of the silver halide grains, with an average grain size of 1.6 μm and an average silver iodide content of 6.4%.

Em-4

Monodispersed type emulsion having a relatively low silver iodide content in the surfacial portion of the silver halide grains, with an average grain size of 2.0 μm and an average silver iodide content of 7.0%.

S-1

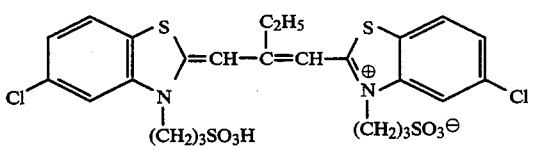

S-2

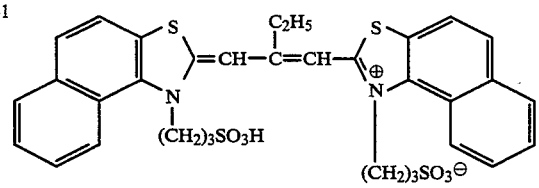

S-3

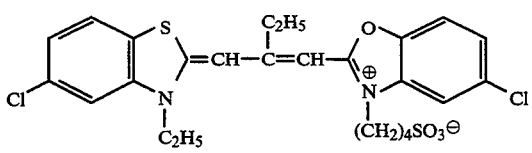

S-4

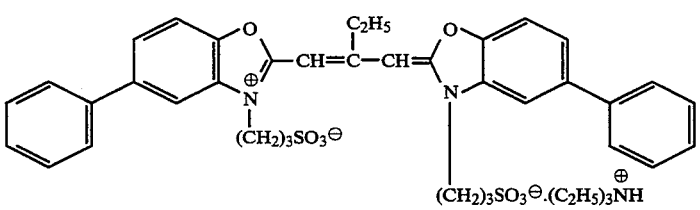

S-5

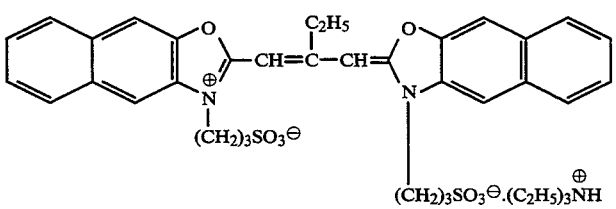

S-6

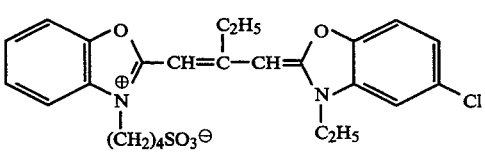

S-7

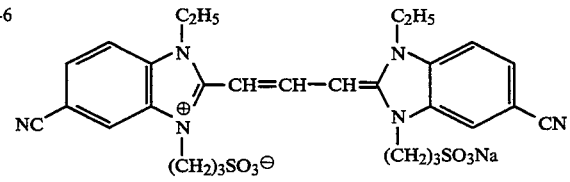

S-8

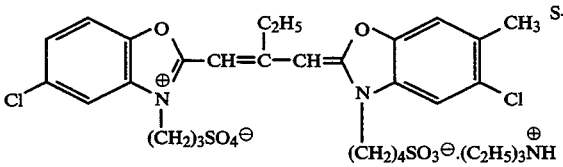

S-9

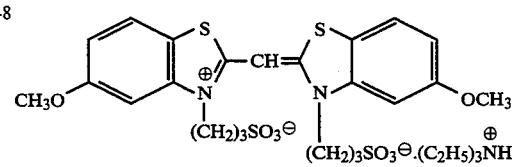

-continued
S-10
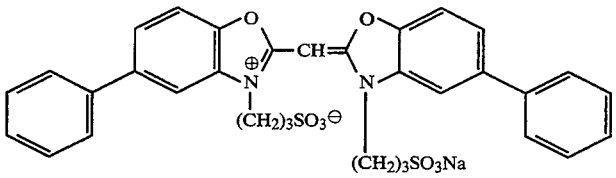
S-11
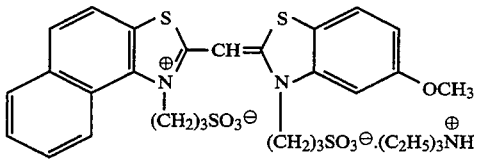
Y'-1
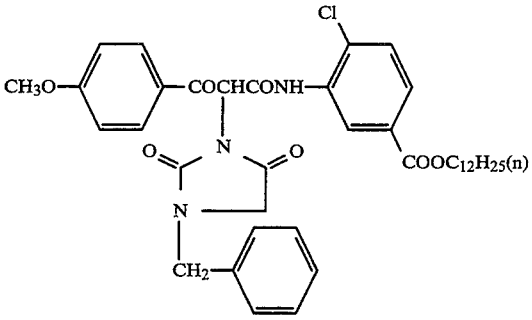
CC-1
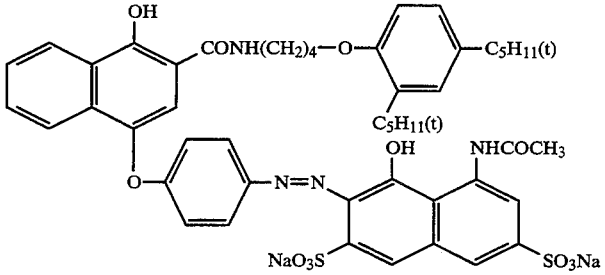
C'-1
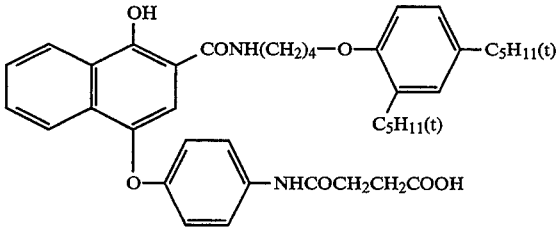
C'-2
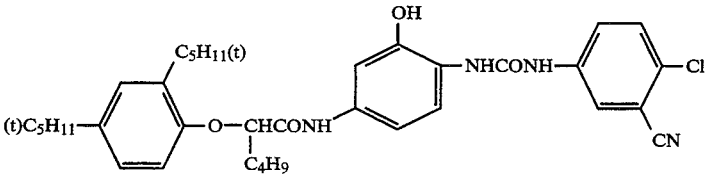
C'-3
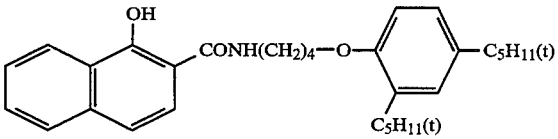
C'-4
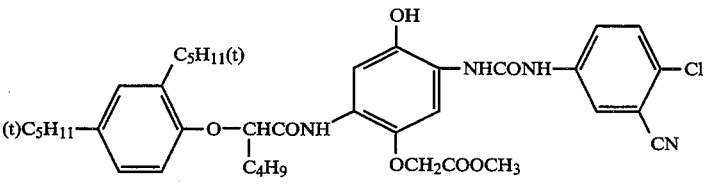

-continued
M'-1
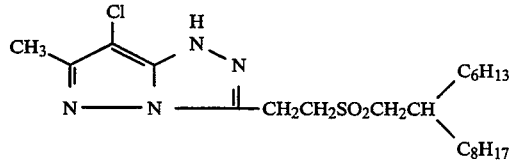
CM-1
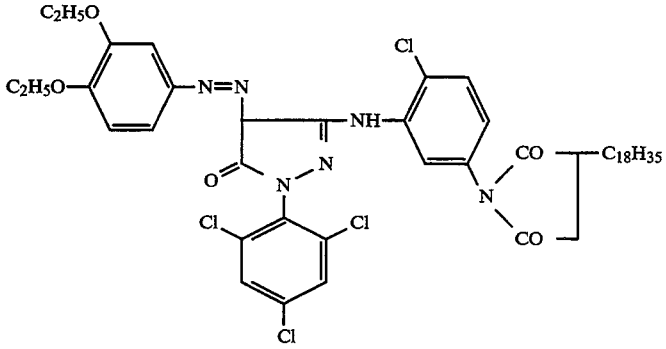
ST-1
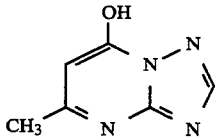
AF-1
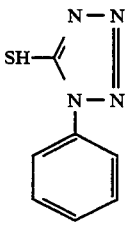
AF-2
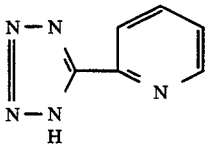
D-1
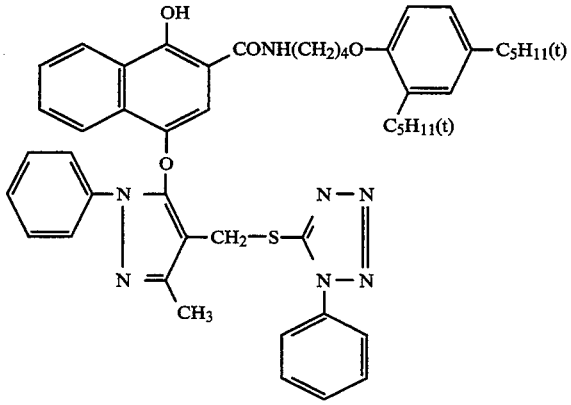
UV-1
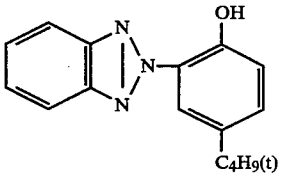
UV-2
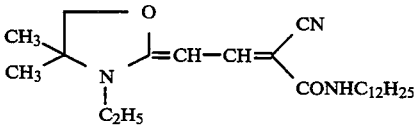
HS-1
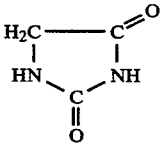
HS-2
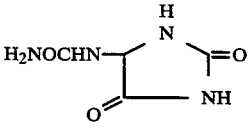

-continued

H-1

$((CH_2{=}CHSO_2CH_2)_3CCH_2SO_2(CH_2)_2)_2N$
$(CH_2)_2SO_3K$

H-2

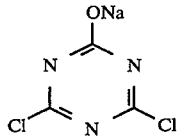

W-1

$NaO_3S-C(H)(C-COOCH_2(CF_2CF_2)_3H)(H_2)-COOCH_2(CF_2CF_2)_3H$

SU-1

$NaO_3S-C(H)(CH_2-COOC_8H_{17})-COOC_8H_{17}$

SU-2

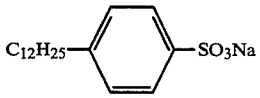

SC-1

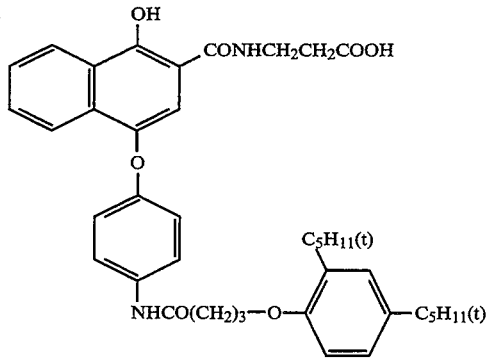

WAX-1

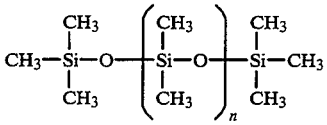

oil-1

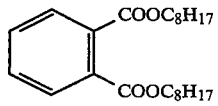

oil-2

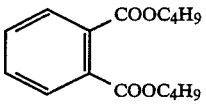

oil-3

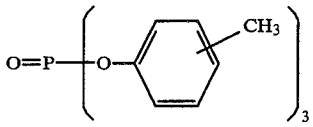

oil-4

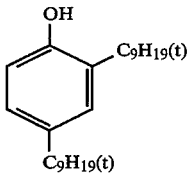

The sample thus prepared was subjected to exposure to white light through an optical wedge and then developed as follows:

| (Experimental processing) Process | Time | Temperature |
|---|---|---|
| Color developing | 3 min 15 sec | 38° C. |
| Bleaching | 45 sec | 37° C. |
| Fixing | 90 sec | 37° C. |
| Stabilization | 60 sec | 37° C. |
| Drying | 60 sec | 70° C. |

The processing solutions used had the following compositions:

| (Color developer) | |
|---|---|
| Potassium carbonate | 30 g |
| Sodium hydrogencarbonate | 2.5 g |
| Potassium sulfite | 4 g |
| Sodium bromide | 1.3 g |
| Potassium iodide | 1.2 mg |
| Hydroxylamine sulfate | 2.5 g |

-continued

| (Color developer) | |
|---|---|
| Sodium chloride | 0.6 g |
| 4-amino-3-methyl-N-ethyl-N-(β-hydroxylethyl)aniline sulfate | 4.8 g |
| Potassium hydroxide | 1.2 g |

Add water to make 1 l, then adjust to pH 10.06 with potassium hydroxide or 50% sulfuric acid.

| (Bleaching solution) | |
|---|---|
| Ferric ammonium salt of examplified compound A-1 | 150 g |
| Compound shown in Table 1 (hereinafter simply referred to as Compound) | 0.4 mol |
| Ammonium bromide | 150 g |

Add water to make 1 l, then adjust to pH 5.2 with aqueous ammonia or glacier acetic acid.

| (Fixer) | |
|---|---|
| Ammonium thiosulfate | 250 g |
| Ammonium sulfite | 20 g |
| Examplified compound A-7 (ammonium salt) | 2 g |

Add water to make 1 l, and adjust to pH 6.8 with acetic acid and aqueous ammonia.

| (Stabilizer) | |
|---|---|
| Formaldehyde (37% sln.) | 2 ml |
| 5-chloro-2-methyl-4-isothiazolin-3-one | 0.05 g |
| Emulgen 810 (surfactant) | 1 ml |
| Additional product of formaldehyde and sodium bisulfite | 2 g |

Add water to make 1 l, and adjust to pH 7.0 with aqueous ammonia and 50% sulfuric acid.

A compound listed in Table 1 was added to the bleaching solution and processing was conducted; minimum densities for B (blue), G (green), and R (red) were measured using an optical densitomer PDA-65A (Konica Corporation).

For comparison, processing using bleaching solution No. 23 was conducted in the presence of a ferric ammonium salt of Example A'-1 in place of ferric ammonium salt of Example A-1 and in the absence of any of the compounds listed in Table 1, with the duration of bleaching increased from 45 sec to 6 min.

For further comparison, processing was conducted under the following conditions (using bleaching solution No. 24).

| Process | Time | Temperature |
|---|---|---|
| Color developing | 3 min 15 sec | 38° C. |
| Stop | 60 sec | 20° C. |
| Washing | 120 sec | 35° C. |
| Bleaching | 45 sec | 37° C. |
| Fixing | 90 sec | 37° C. |
| Stabilization | 60 sec | 37° C. |
| Drying | 60 sec | 70° C. |

A stop solution was prepared as follows and used; the bleaching solution used was the same as the above-mentioned bleaching solution, but none of the compounds of Table 1 was added; the color developer, fixer, and stabilizer used were the same as above.

The results are shown in Table 1.

(Stop solution)

Acetic acid 20 g

Add water to make 1 l, and adjust to pH 4.0 with sodium hydroxide.

Add water to make 1 l, and adjust to pH 4.0 with sodium hydroxide.

A 5-fold concentrate of each color developer was prepared and added to the bleaching solution used in the above experiment at 50 ml/l; this mixture was left for one day and then visually observed for surface floating solids by 3 persons. The results are shown in Table 2.

TABLE 1

| Experiment No. | Compound added to bleaching solution | Bleach fogging (minimum density portion) B | G | R | Remark |
|---|---|---|---|---|---|
| 1 | Acrylic acid | 0.82 | 0.58 | 0.44 | Present |

TABLE 1-continued

| Experiment No. | Compound added to bleaching solution | Bleach fogging (minimum density portion) B | G | R | Remark |
|---|---|---|---|---|---|
| 2 | Adipic acid | 0.82 | 0.58 | 0.44 | invention |
| 3 | Acetoacetic acid | 0.82 | 0.58 | 0.44 | |
| 4 | Isopropylmalonic acid | 0.82 | 0.58 | 0.44 | |
| 5 | Isobutyric acid | 0.82 | 0.58 | 0.44 | |
| 6 | Itaconic acid | 0.82 | 0.58 | 0.44 | |
| 7 | Formic acid | 0.81 | 0.57 | 0.43 | |
| 8 | Valeric acid | 0.80 | 0.56 | 0.43 | |
| 9 | Citric acid | 0.80 | 0.56 | 0.43 | |
| 10 | Glutaric acid | 0.81 | 0.57 | 0.43 | |
| 11 | Succinic acid | 0.80 | 0.56 | 0.43 | |
| 12 | Diethylmalonic acid | 0.82 | 0.58 | 0.44 | |
| 13 | Oxalic acid | 0.81 | 0.57 | 0.43 | |
| 14 | d-tartaric acid | 0.80 | 0.56 | 0.43 | |
| 15 | Fumaric acid | 0.81 | 0.58 | 0.43 | |
| 16 | Malonic acid | 0.82 | 0.58 | 0.44 | |
| 17 | n-butyric acid | 0.82 | 0.58 | 0.44 | |
| 18 | Malic acid | 0.80 | 0.56 | 0.43 | |
| 19 | Glutamic acid | 0.82 | 0.58 | 0.44 | |
| 20 | Not added | 0.99 | 0.67 | 0.51 | Comparison |
| 21 | Ethanol | 0.99 | 0.66 | 0.51 | |
| 22 | Ethylene glycol | 0.99 | 0.67 | 0.52 | |
| 23 | Bleaching was conducted in the presence of a ferric salt of A'-1 in place of A-1 for 6 min. | 0.80 | 0.57 | 0.43 | |
| 24 | Color developing was followed by stop-washing-bleaching. | 0.80 | 0.56 | 0.43 | |

TABLE 2

| Experiment No. | Solution surface |
|---|---|
| 1 | + |
| 2 | + |
| 3 | + |
| 4 | + |
| 5 | + |
| 6 | + |
| 7 | + |
| 8 | + |
| 9 | + |
| 10 | + |
| 11 | + |
| 12 | + |
| 13 | + |
| 14 | + |
| 15 | + |
| 16 | + |
| 17 | + |
| 18 | + |
| 19 | + |
| 20 | +++ |
| 21 | +++ |
| 22 | +++ |
| 23 | – |

– No suspended solids
+ Floating solids are present, less than 1/5 area.
++ Floating solids are present, 1/5 to ½ area.
+++ Floating solids are present, over ½ area.

The symbols for floating solids in the following tables indicate the same as above.

AS seen in Table 1, it is evident that a good preventive effect on bleach fogging is obtained when the bleaching solution incorporates both a ferric complex salt of organic acid of the present invention and buffer capable of adjusting to pH 3 to 7.

It is also evident that a lack of any one of these conditions results in a loss of the anti-bleach fogging effect.

Also, similar results were obtained in experiments using ferric salts of B-1 in place ferric salts of A-1.

EXAMPLE 2

Experiments were conducted using cyclic compounds as buffers capable of adjusting to pH 3 to 7 in the same manner as Example 1. The results are shown in Tables 3 and 4.

TABLE 3

| Experiment No. | Compound added to bleaching solution | Bleach fogging (minimum density portion) B | G | R | Remark |
|---|---|---|---|---|---|
| 25 | Isophthalic acid | 0.83 | 0.59 | 0.44 | Present invention |
| 26 | Salicylic acid | 0.83 | 0.58 | 0.44 | |
| 27 | 2,4-dioxobenzoic acid | 0.83 | 0.59 | 0.44 | |
| 28 | Cyclobutane-1,1-dicarboxylic acid | 0.83 | 0.59 | 0.44 | |
| 29 | 3,5-dinitrobenzoic acid | 0.82 | 0.58 | 0.43 | |
| 30 | Sulfanylic acid | 0.84 | 0.60 | 0.45 | |
| 31 | Terephthalic acid | 0.83 | 0.58 | 0.44 | |
| 32 | Uric acid | 0.83 | 0.59 | 0.44 | |
| 33 | Picolic acid | 0.84 | 0.60 | 0.45 | |
| 34 | Phthalic acid | 0.83 | 0.58 | 0.44 | |
| 35 | Gallic acid | 0.84 | 0.61 | 0.45 | |
| 20 | Not added | 0.99 | 0.67 | 0.51 | Comparison |
| 36 | Phenol | 1.01 | 0.68 | 0.52 | |
| 37 | Nitrobenzene-sulfonic acid | 0.99 | 0.67 | 0.51 | |
| 38 | Cyclohexanone | 1.04 | 0.70 | 0.53 | |

TABLE 4

| Experiment No. | Solution surface |
|---|---|
| 25 | + |
| 26 | + |
| 27 | + |
| 28 | + |
| 29 | + |
| 30 | + |
| 31 | + |
| 32 | + |
| 33 | + |
| 34 | + |
| 35 | + |
| 20 | +++ |
| 36 | +++ |
| 37 | +++ |
| 38 | +++ |

Also, similar results were obtained in experiments using ferric salts of B-1 in place of ferric salts of A-1.

EXAMPLE 3

Experiments were conducted using nitrogen-containing compounds as buffers capable of adjusting of pH 3 to 7 in the same manner as Example 1. The results are shown in Tables 5 and 6.

TABLE 5

| Experiment No. | Compound added to bleaching solution | Bleach fogging (minimum density portion) B | G | R | Remark |
|---|---|---|---|---|---|
| 39 | Isopropylamine | 0.85 | 0.60 | 0.45 | Present invention |
| 40 | Ethylamine | 0.86 | 0.61 | 0.45 | |
| 41 | Dimethylamine | 0.85 | 0.60 | 0.45 | |
| 42 | Triethylamine | 0.85 | 0.60 | 0.45 | |
| 43 | Hexamethylene-tetramine | 0.84 | 0.59 | 0.44 | |
| 44 | Benzylamine | 0.85 | 0.60 | 0.45 | |
| 45 | Cyclohexylamine | 0.85 | 0.60 | 0.45 | |
| 46 | Piperazine | 0.85 | 0.60 | 0.45 | |

TABLE 5-continued

| Experiment No. | Compound added to bleaching solution | Bleach fogging (minimum density portion) B | G | R | Remark |
|---|---|---|---|---|---|
| 20 | Not added | 0.99 | 0.67 | 0.51 | Comparison |
| 47 | Ethyl alcohol | 0.99 | 0.67 | 0.51 | |
| 48 | Benzyl alcohol | 1.32 | 0.79 | 0.63 | |
| 49 | Aqueous ammonia | 0.98 | 0.67 | 0.50 | |
| 50 | Tetramethylammonium chloride | 1.02 | 0.68 | 0.53 | |
| 51 | Tetraethylammonium chloride | 1.04 | 0.69 | 0.53 | |

TABLE 6

| Experiment No. | Solution surface |
|---|---|
| 39 | + |
| 40 | + |
| 41 | + |
| 42 | + |
| 43 | + |
| 44 | + |
| 45 | + |
| 46 | + |
| 20 | +++ |
| 47 | +++ |
| 48 | +++ |
| 49 | +++ |
| 50 | +++ |
| 51 | +++ |

Also, similar results were obtained in experiments using ferric salt of B-1 in place of ferric salts of A-1.

EXAMPLE 4

Experiments were conducted using inorganic salts and other compounds as buffers capable of adjusting to pH 3 to 7 in the same manner as Example 1. The results are shown in Tables 7 and 8.

TABLE 7

| Experiment No. | Compound added to bleaching solution | Bleach fogging (minimum density portion) B | G | R | Remark |
|---|---|---|---|---|---|
| 52 | Nitrous acid | 0.86 | 0.62 | 0.46 | Present invention |
| 53 | Phosphorous acid | 0.85 | 0.60 | 0.45 | |
| 54 | Phosphoric acid | 0.85 | 0.60 | 0.45 | |
| 55 | Triphosphoric acid | 0.85 | 0.60 | 0.45 | |
| 56 | Tetrapolyphosphoric acid | 0.85 | 0.60 | 0.45 | |
| 57 | N-(2-acetamido) iminodiacetic acid | 0.85 | 0.60 | 0.45 | |
| 58 | 2-(N-morpholino) ethanesulfonic acid | 0.86 | 0.61 | 0.45 | |
| 59 | Ethylenediamine-2-propionic acid | 0.85 | 0.60 | 0.45 | |
| 60 | Piperazine-N,N'-bis-2-ethane-sulfonic acid | 0.85 | 0.61 | 0.45 | |
| 20 | Not added | 0.99 | 0.67 | 0.51 | Comparison |
| 61 | Hydrochloric acid | 0.99 | 0.68 | 0.51 | |
| 62 | Sulfuric acid | 0.99 | 0.67 | 0.50 | |
| 63 | Nitric acid | 0.98 | 0.66 | 0.51 | |

TABLE 8

| Experiment No. | Solution surface |
|---|---|
| 52 | + |
| 53 | + |
| 54 | + |
| 55 | + |
| 56 | + |
| 57 | + |
| 58 | + |

TABLE 8-continued

| Experiment No. | Solution surface |
|---|---|
| 59 | + |
| 60 | + |
| 20 | +++ |
| 61 | +++ |
| 62 | +++ |
| 63 | +++ |

Also, similar results were obtained in experiments using ferric salts of B-1 in place of ferric salts of A-1.

EXAMPLE 5

Experiments were conducted using organic phosphoric acids as buffers capable of adjusting to pH 3 to 7 in the same manner as Example 1. The results are shown in Tables 9 and 10.

TABLE 9

| Experiment No. | Compound added to bleaching solution | Bleach fogging (minimum density portion) B | G | R | Remark |
|---|---|---|---|---|---|
| 64 | Nitrilotris (methylenephosphonic acid) | 0.86 | 0.60 | 0.45 | Present invention |
| 65 | Ethyleneidamine-tetrakis(methylene-phosphonic acid) | 0.86 | 0.60 | 0.45 | |
| 66 | Aminomethylphosphono-N,N-diacetic acid | 0.86 | 0.60 | 0.45 | |
| 67 | 2-phosphonoethyl-iminodiacetic acid | 0.86 | 0.60 | 0.45 | |
| 68 | Examplified compound (P-34) | 0.86 | 0.60 | 0.46 | |
| 69 | Examplified compound (P-15) | 0.86 | 0.60 | 0.46 | |
| 20 | Not added | 0.99 | 0.67 | 0.51 | Comparison |
| 70 | A-1 | 0.98 | 0.67 | 0.51 | |
| 71 | A'-1 | 0.98 | 0.67 | 0.51 | |

TABLE 10

| Experiment No. | Solution surface |
|---|---|
| 64 | ++ |
| 65 | ++ |
| 66 | ++ |
| 67 | ++ |
| 68 | ++ |
| 69 | ++ |
| 20 | +++ |
| 70 | +++ |
| 71 | +++ |

Also, similar results were obtained in experiments using ferric salts of B-1 in place of ferric salts of A-1.

EXAMPLE 6

Experiments were conducted using varied amounts of citric acid and acetic acid in the same manner as Example 1. The results are shown in Tables 11 and 12.

TABLE 10

| Experiment No. | Compound added to bleaching solution (mol/l) | | Bleach fogging (minimum density portion) B | G | R | Remark |
|---|---|---|---|---|---|---|
| 72 | Citric acid | 0.1 | 0.84 | 0.59 | 0.45 | Present invention |
| 73 | | 0.3 | 0.82 | 0.57 | 0.44 | |
| 74 | | 0.5 | 0.80 | 0.56 | 0.43 | |
| 75 | | 0.7 | 0.80 | 0.56 | 0.43 | |
| 76 | | 1.0 | 0.80 | 0.56 | 0.43 | |

TABLE 10-continued

| Experiment No. | Compound added to bleaching solution (mol/l) | | Bleach fogging (minimum density portion) B | G | R | Remark |
|---|---|---|---|---|---|---|
| 77 | | 2.0 | 0.80 | 0.56 | 0.43 | |
| 78 | Acetic acid | 0.1 | 0.96 | 0.65 | 0.49 | |
| 79 | | 0.3 | 0.93 | 0.64 | 0.48 | |
| 80 | | 0.5 | 0.88 | 0.62 | 0.46 | |
| 81 | | 0.7 | 0.85 | 0.59 | 0.45 | |
| 82 | | 1.0 | 0.85 | 0.59 | 0.45 | |
| 83 | | 2.0 | 0.85 | 0.59 | 0.45 | |
| 20 | Not added | | 0.99 | 0.67 | 0.51 | Comparison |

TABLE 12

| Experiment No. | Solution surface |
|---|---|
| 72 | ++ |
| 73 | + |
| 74 | + |
| 75 | + |
| 76 | + |
| 77 | + |
| 78 | +++ |
| 79 | ++ |
| 80 | + |
| 81 | – |
| 82 | – |
| 83 | – |
| 20 | +++ |

Also, similar results were obtained in experiments using ferric salts of B-1 in place of ferric salts of A-1.

EXAMPLE 7

Bleach fogging was tested with the pH of the bleacher varied by adding 0.3 mol/l citric acid and 0.3 mol/l 1-(N-morpholino)ethanesulfonic acid. The results are shown in Table 13.

TABLE 13

| Experiment No. | Compound added to bleaching solution (pH) | | Bleach fogging (minimum density portion) B | G | R | Remark |
|---|---|---|---|---|---|---|
| 84 | Not added | 2.0 | 0.80 | 0.53 | 0.43 | Comparison |
| 85 | | 3.0 | 0.84 | 0.55 | 0.44 | |
| 86 | | 4.0 | 0.90 | 0.60 | 0.47 | |
| 87 | | 5.0 | 0.97 | 0.66 | 0.50 | |
| 88 | | 6.0 | 1.16 | 0.75 | 0.63 | |
| 89 | | 7.0 | 1.27 | 0.89 | 0.72 | |
| 90 | | 8.0 | 1.49 | 1.12 | 0.91 | |
| 91 | 0.3 mol/l | 2.0 | 0.80 | 0.53 | 0.43 | Comparison |
| 92 | citric acid | 3.0 | 0.80 | 0.53 | 0.43 | Present |
| 93 | and 0.3 mol/l | 4.0 | 0.80 | 0.53 | 0.43 | invention |
| 94 | 2-(N- | 5.0 | 0.80 | 0.53 | 0.43 | |
| 95 | morpholino) | 6.0 | 0.81 | 0.53 | 0.43 | |
| 96 | ethanesul- | 7.0 | 0.89 | 0.58 | 0.46 | |
| 97 | fornic acid | 8.0 | 1.23 | 0.88 | 0.71 | Comparison |

From Tables 3 through 10, it is evident that the addition of a buffer capable of adjusting to pH 3 to 7 of the present invention is effective. It is also evident from Tables 11 and 12 that acetic acid is needed in large amounts since it is weaker than other compounds; it is recommended that acetic acid be present at over 0.5, preferably over 0.7. Furthermore, Table 13 shows that the bleacher of the present invention functions well at pH 3 to 7.

Also, similar results were obtained in experiments using ferric salts of B-1 in place of those of A-1.

EXAMPLE 8

Experiments were conducted using ferric ammonium salts of chelating agents other than Examplified A-1 in the presence/absence of citric acid. Bleaching time was fixed at 6 min so that bleaching could be achieved even when the chelating agent had low bleaching power. The results are shown in Table 14.

TABLE 14

| Ferric salt chelating agent | Not added Minimum density portion | | | Citric acid, 0.5 mol/l Minimum density portion | | |
|---|---|---|---|---|---|---|
| | B | G | R | B | G | R |
| A-1 | 0.99 | 0.67 | 0.51 | 0.80 | 0.56 | 0.43 |
| A-3 | 0.94 | 0.65 | 0.49 | 0.80 | 0.56 | 0.43 |
| A-4 | 0.92 | 0.64 | 0.48 | 0.80 | 0.56 | 0.43 |
| A-7 | 0.88 | 0.62 | 0.47 | 0.80 | 0.56 | 0.43 |
| B-1 | 0.98 | 0.67 | 0.51 | 0.80 | 0.56 | 0.43 |
| B-5 | 0.91 | 0.63 | 0.48 | 0.80 | 0.56 | 0.43 |
| A'-1 | 0.80 | 0.56 | 0.43 | 0.80 | 0.56 | 0.43 |
| A'-7 | 0.80 | 0.56 | 0.43 | 0.80 | 0.56 | 0.43 |
| A'-15 | 0.80 | 0.56 | 0.43 | 0.80 | 0.56 | 0.43 |
| A'-4 | 0.80 | 0.56 | 0.43 | 0.80 | 0.56 | 0.43 |

From Table 14, it is evident that the ferric complex salts of organic acids of the present invention other than Examplified Compound A-1 have an anti-bleaching fogging effect when used in accordance with the present invention. Also, similar effects were confirmed when Examplified Compound A-1 and B-1 were used in combination at a ratio of 1 to 1.

EXAMPLE 9

The following layers with the respective compositions were formed on a triacetyl cellulose film base in due order, starting at the base side, to prepare the multilayer color photographic light-sensitive material sample 2.

| Sample 2 | |
|---|---|
| Layer 1: Antihalation layer (HC-1) | |
| Black colloidal silver | 0.22 |
| Ultraviolet absorber (UV-1) | 0.20 |
| Colored coupler (CC-1) | 0.05 |
| Colored coupler (CM-2) | 0.05 |
| High boiling point solvent (oil-1) | 0.20 |
| Gelatin | 1.4 |
| Layer 2: Interlayer (IL-1) | |
| Ultraviolet absorber (UV-1) | 0.01 |
| High boiling point solvent (oil-1) | 0.01 |
| Gelatin | 1.4 |
| Layer 3: Low-sensitivity red-sensitive emulsion layer (RL) | |
| Silver iodobromide emulsion (Em-5) | 1.0 |
| Silver iodobromide emulsion (Em-6) | 0.5 |
| Sensitizing dye (S-1) | $2.5 \times 10^{-4}$ (mol/mol silver) |
| Sensitizing dye (S-3) | $2.5 \times 10^{-4}$ (mol/mol silver) |
| Sensitizing dye (S-2) | $0.5 \times 10^{-4}$ (mol/mol silver) |
| Cyan coupler (C-4) | 1.2 |
| Cyan coupler (C-1) | 0.06 |
| Colored cyan coupler (CC-1) | 0.05 |
| DIR compound (D-2) | 0.002 |
| High boiling point solvent (oil-1) | 0.5 |
| Gelatin | 1.4 |
| Layer 4: High sensitivity red-sensitive emulsion layer (RH) | |
| Silver iodobromide emulsion (Em-7) | 2.0 |
| Sensitizing dye (S-1) | $2.0 \times 10^{-4}$ (mol/mol silver) |
| Sensitizing dye (S-3) | $2.0 \times 10^{-4}$ (mol/mol silver) |
| Sensitizing dye (S-2) | $0.1 \times 10^{-4}$ (mol/mol silver) |
| Cyan coupler (C-2) | 0.15 |

-continued

| Sample 2 | |
|---|---|
| Cyan coupler (C-1) | 0.018 |
| Cyan coupler (C-3) | 1.15 |
| Colored cyan coupler (CC-1) | 0.015 |
| DIR compound (D-3) | 0.05 |
| High boiling point solvent (oil-4) | 0.5 |
| Gelatin | 1.4 |
| Layer 5: Interlayer (IL-2) | |
| Gelatin | 0.5 |
| Layer 6: Low sensitivity green-sensitive emulsion layer (GL) | |
| Silver iodobromide emulsion (Em-5) | 1.0 |
| Sensitizing dye (S-8) | $5.0 \times 10^{-4}$ (mol/mol silver) |
| Sensitizing dye (S-7) | $1.0 \times 10^{-4}$ (mol/mol silver) |
| Magenta coupler (M-1) | 0.5 |
| Colored magenta coupler (CM-1) | 0.05 |
| DIR compound (D-4) | 0.015 |
| DIR compound (D-5) | 0.020 |
| High boiling point solvent (oil-2) | 0.5 |
| Gelatin | 1.0 |
| Layer 7: Interlayer (IL-3) | |
| Gelatin | 0.8 |
| High boiling point solvent (oil-1) | 0.2 |
| Layer 8: High sensitivity green-sensitive emulsion layer (GH) | |
| Silver iodobromide emulsion (Em-7) | 1.3 |
| Sensitizing dye (S-5) | $1.5 \times 10^{-4}$ (mol/mol silver) |
| Sensitizing dye (S-4) | $2.5 \times 10^{-4}$ (mol/mol silver) |
| Sensitizing dye (S-6) | $0.5 \times 10^{-4}$ (mol/mol silver) |
| Magenta coupler (M-2) | 0.06 |
| Magenta coupler (M-3) | 0.18 |
| Colored magenta coupler (CM-2) | 0.05 |
| DIR compound (D-4) | 0.01 |
| High boiling point solvent (oil-3) | 0.5 |
| Gelatin | 1.0 |
| Layer 9: Yellow filter layer (YC) | |
| Yellow colloidal silver | 0.1 |
| Anti-stain agent (SC-2) | 0.1 |
| High boiling point solvent (oil-3) | 0.1 |
| Gelatin | 0.8 |
| Layer 10: Low sensitivity blue-sensitive emulsion layer (BL) | |
| Silver iodobromide emulsion (Em-5) | 0.25 |
| Silver iodobromide emulsion (Em-6) | 0.25 |
| Sensitizing dye (S-9) | $7.0 \times 10^{-4}$ (mol/mol silver) |
| Yellow coupler (Y-1) | 0.6 |
| Yellow coupler (Y-2) | 0.12 |
| DIR compound (D-3) | 0.01 |
| High boiling point solvent (oil-3) | 0.15 |
| Gelatin | 1.0 |
| Layer 11: High sensitivity blue-sensitive emulsion layer (BH) | |
| Silver iodobromide emulsion (Em-8) | 0.50 |
| Silver iodobromide emulsion (Em-5) | 0.20 |
| Sensitizing dye (S-10) | $1.0 \times 10^{-4}$ (mol/mol silver) |
| Sensitizing dye (S-9) | $3.0 \times 10^{-4}$ (mol/mol silver) |
| Yellow coupler (Y-1) | 0.36 |
| Yellow coupler (Y-2) | 0.06 |
| High boiling point solvent (oil-3) | 0.07 |
| Gelatin | 1.1 |
| Layer 12: 1st protective layer (Pro-1) | |
| Fine-grain silver iodobromide emulsion (average grain size, 0.08 μm; AgI = 2 mol %) | 0.4 |
| Ultraviolet absorber (UV-1) | 0.10 |
| Ultraviolet absorber (UV-2) | 0.05 |
| High boiling point solvent (oil-1) | 0.1 |
| High boiling point solvent (oil-2) | 0.1 |
| Formalin scavenger (HS-1) | 0.5 |
| Formalin scavenger (HS-2) | 0.2 |
| Gelatin | 1.0 |
| Layer 13: 2nd protective layer (Pro-2) | |
| Antistatic agent (W-1) | 0.005 |
| Alkali-soluble matting agent | 0.10 |

-continued

| Sample 2 | |
|---|---|
| (average grain size, 2 μm) | |
| Cyan dye (AIC-1) | 0.005 |
| Magenta dye (AIM-1) | 0.01 |
| Lubricant (WAX-1) | 0.04 |
| Gelatin | 0.8 |

Note that the coating aid Su-1, dispersion aid Su-2, hardeners H-1 and H-2, preservative DI-1, stabilizer ST-1, and anti-fogging agents AF-1 and AF-2 were also added to each layer.

Em-5

Monodisperse type emulsion having a relatively low silver iodide content in the surface portion of the silver halide grains with an average grain size of 0.46 μm and an average silver iodide content of 7.5%.

Em-6

Monodisperse type uniformely composed emulsion with an average grain size of 0.32 μm and an average silver iodide content of 2.0%.

Em-7

Monodisperse type emulsion having a relatively low silver iodide content in the surface portion of the silver halide grains, with an average grain size of 0.78 μm and an average silver iodide content of 6.0%.

Em-8

Monodisperse type emulsion having a relatively low silver iodide content in the surfacial portion of the silver halide grains, with an average grain size of 0.95 μm and an average silver iodide content of 8.0%.

Em-5, Em-7 and Em-8 are silver iodobromide emulsions composed mainly of octahedral grains, with multilayer structures as prepared in accordance with Japanese Patenet Publication Open to Inspection Nos. 60-138538/1985 and 61-245151/1986.

In each of Em-5 through Em-8, the average value of grain diameter/grain thickness was 1.0, with the width of variation of grain distribution of 14, 10, 12, and 12%, respectively.

M-2

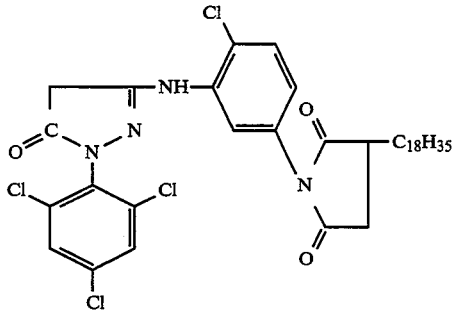

M-3

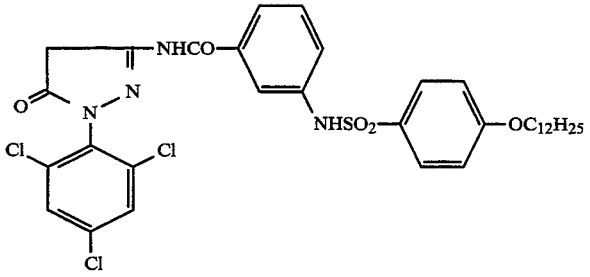

CM-2

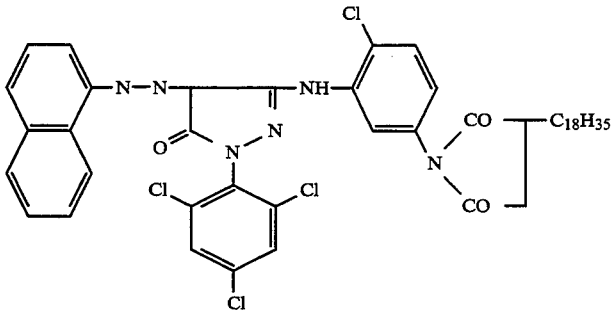

-continued
D-2
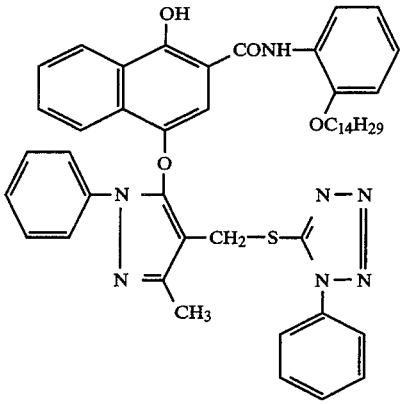
D-3
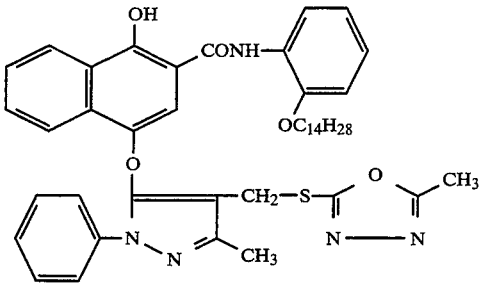
D-4
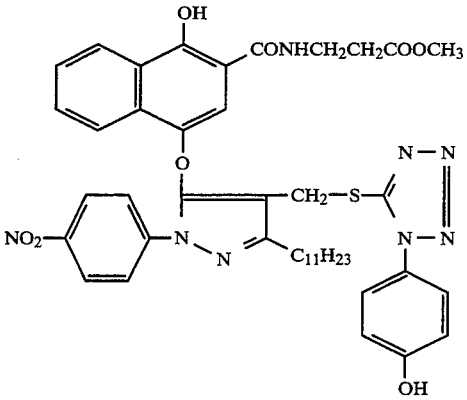
D-5
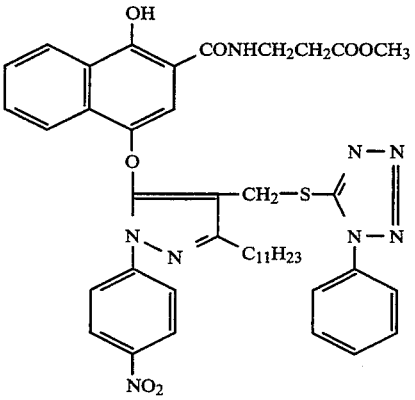
SC-2
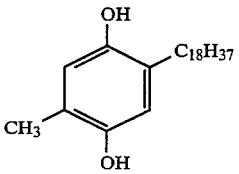
AIC-1
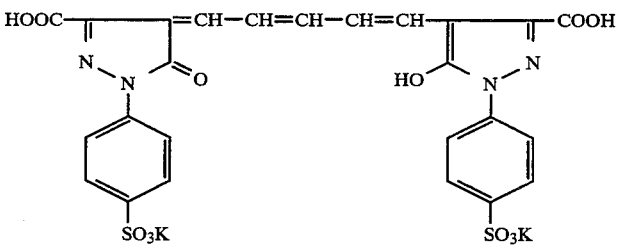

-continued

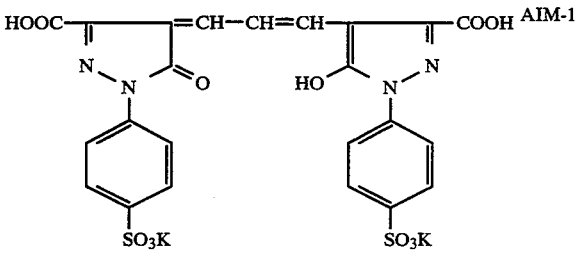

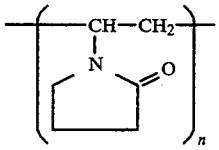

AF-2

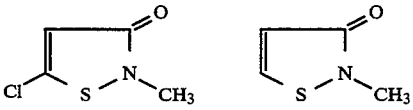

DI-1

The sample thus prepared was subjected to exposure to white light through and optical wedge and then developed as follows:

The tank solutions used had the same compositions as Example 1; replenishers of the following compositions were also used for running processing.

| (Color developer replenisher) | |
|---|---|
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-amino-3-methyl-N-ethyl-N-(β-hydroxylethyl)aniline sulfate | 6.0 g |
| Potassium hydroxide | 2 g |

Add water to make 1 l, and adjust to pH 10.12 with podassium hydroxide or 20% sulfuric acid. (Bleaching solution)

The same bleaching solution as in Example 1, but adjusted to pH 4.8.

The fixer replenishers and stabilizer replenisher used were the same as in Example 1.

The processes, processing time, processing temperature and replenisher amount in running processing were as follows:

| Process | Processing time | Processing temperature | Replenisher amount |
|---|---|---|---|
| Color developing | 3 min 15 sec | 38° C. | 12 ml |
| Bleaching | 45 sec | 37° C. | 1.5 ml |
| Fixing | 1 min 30 sec | 37° C. | 10 ml |
| Stabilization | 60 sec | 37° C. | 10 ml |
| Drying | 60 sec | 70° C. | — |

(The amounts of replenishers are shown in ml per 100 $cm^2$ light-sensitive material.)

Note that fixing was conducted by the 2-tank counter current method (45 sec, 2 tanks) and stabilization conducted by the 3-tank counter current method (20 sec, 3 tanks).

Running processing was conducted until the bleaching solution replenisher amount became two times the capacity of the bleaching tank in 40 days. After completion of running processing, the film sample was measured in the same manner as Example 1, except that running processing was conducted in the absence/presence of 0.4 mol/l citric acid or 1.5 mol/l acetic acid, with the amount of bleacher replenisher varied to 0.75, 1.5, 5, and 10 ml per 100 $cm^2$.

Also, experiments were conducted in the same manner as Example 1, but the color developing tank, bleaching tank, fixing tank and stabilizing tank were each provided with a vinyl chloride nozzle having an opening of a 0.5 mm diameter and an Iwake magnet pump MD-15 was used to jet the processing solutions to the surface of light-sensitive emulsion; the bleaching tank alone was subjected to aeration at a rate such that the volume of air equaled the capacity of the bleaching tank in 2 minutes. Aeration was continued during the light-sensitive material was loaded in the automatic developer.

The results are summarized in Table 15.

TABLE 15

| Experiment No. | Compound added to bleaching solution | Amount of replenisher | Bleach fogging (minimum density) B | G | R | Tank solution surface appearance |
|---|---|---|---|---|---|---|
| 101 | Not added | 0.75 | 1.17 | 0.75 | 0.63 | +++ |
| 102 | | 1.5 | 1.06 | 0.72 | 0.57 | +++ |
| 103 | | 5.0 | 1.03 | 0.69 | 0.54 | ++ |
| 104 | | 10.0 | 1.01 | 0.68 | 0.52 | + |
| 105 | Citric acid, | 0.75 | 0.85 | 0.59 | 0.45 | + |
| 106 | 0.4 mol/l | 1.5 | 0.83 | 0.58 | 0.44 | + |
| 107 | | 5.0 | 0.81 | 0.57 | 0.43 | – |
| 108 | | 10.0 | 0.81 | 0.57 | 0.43 | – |
| 109 | Acetic acid, | 0.75 | 0.87 | 0.60 | 0.46 | – |
| 110 | 1.5 mol/l | 1.5 | 0.86 | 0.59 | 0.45 | – |
| 111 | | 5.0 | 0.85 | 0.59 | 0.45 | – |
| 112 | | 10.0 | 0.85 | 0.59 | 0.45 | – |

Note:
The evaluation criteria for tank solution surface appearance were the same as in Example 1.

From Table 15, it is evident that the processing method of the present invention is favorable both in preventing bleach fogging and in solution appearance.

EXAMPLE 10

Experiments were conducted in the same manner as Example 1, but the color developing agent 4-amino-3-methyl-N-ethyl-N-(β-hydroxylethyl)aniline sulfate was present in the color developer in the amounts shown in Table 16, and processing time was varied as shown in Table 16. Processing time was adjusted so that sensitometry results agreed with each other.

Bleaching was conducted in the absence/presence of 0.8 mol/l citric acid in the bleaching solution.

For comparison, experiments with a stop process were conducted in the same manner as Experiment No. 24 of Example 1. The results are shown in Table 16.

TABLE 16

| Compound added to bleaching solution | Color developer Agent concentration | Color developer Time | Minimum density portion: Color developing-bleaching B | G | R | Color developing-stop-bleaching B | G | R |
|---|---|---|---|---|---|---|---|---|
| Not added | $1 \times 10^{-2}$ | 3 min 30 sec | 0.97 | 0.66 | 0.50 | 0.80 | 0.56 | 0.43 |
| | $1.5 \times 10^{-2}$ | 2 min 50 sec | 1.05 | 0.72 | 0.58 | 0.81 | 0.57 | 0.44 |
| | $2 \times 10^{-2}$ | 2 min 10 sec | 1.23 | 0.87 | 0.69 | 0.82 | 0.57 | 0.44 |
| | $4 \times 10^{-2}$ | 1 min 40 sec | 1.44 | 1.10 | 0.90 | 0.83 | 0.58 | 0.45 |
| Citric acid, 0.8 mol/l | $1 \times 10^{-2}$ | 3 min 30 sec | 0.80 | 0.56 | 0.43 | 0.80 | 0.56 | 0.43 |
| | $1.5 \times 10^{-2}$ | 2 min 50 sec | 0.80 | 0.56 | 0.43 | 0.81 | 0.56 | 0.44 |
| | $2 \times 10^{-2}$ | 2 min 10 sec | 0.81 | 0.57 | 0.44 | 0.82 | 0.57 | 0.44 |
| | $4 \times 10^{-2}$ | 1 min 40 sec | 0.82 | 0.57 | 0.44 | 0.83 | 0.58 | 0.45 |

EXAMPLE 11

Each samples was continuously processed, with and without conducting the same aeration as in Example 9, by adding the replenisher in the same amount of 1.5 ml/100 $cm^2$ as in Experiment Nos. 102, 106 and 110. After the maximum cyan density of the resulted was measured, the sample was retreated with a newly prepared fresh bleaching solution. A non-recurring phenomenon on the cyan image due to continuous processing was determined by comparison the maximum density values obtained before and after retreatment. Table 17 shows each of the non-recurring ratios (%) which is defined as a ratio (%) of a difference between the maximum density values obtained before and after retreatment with the fresh bleaching solution to the maximum sensity value before the retreatment.

TABLE 17

| Compound added to bleaching solution | Aeration | Minimum density B | G | R | Ratio of non-recurring for cyan Dmax |
|---|---|---|---|---|---|
| Not added | Not added | 0.92 | 0.63 | 0.51 | 13% |
| | Conducted | 1.06 | 0.72 | 0.57 | 2% |
| Citric acid, 0.4 mol/l | Not added | 0.80 | 0.57 | 0.43 | 12% |
| | Conducted | 0.83 | 0.58 | 0.44 | 2% |
| Acetic acid, 1.5 mol/l | Not added | 0.80 | 0.57 | 0.43 | 13% |
| | Conducted | 0.86 | 0.59 | 0.45 | 2% |

Note that smaller values of the ratio of poor color recovery for cyan Dmax indicate lower degrees of color recovery failure.

From Table 17, it is evident that aeration was effective.

EXAMPLE 12

Processing and evaluation were conducted in the same manner as Experiment Nos. 13 (succinic acid was used as pH buffer) and 20 (no pH buffer) of Example 1, but the cyan couplers listed in Table 18 were used in place of the cyan couplers C-1 and C-4 in molar amounts equal to those of C-1 and C-4.

The results for minimum density of cyan dye, determined with red light, are shown in Table 18.

TABLE 18

| Sample No. | Cyan coupler | R (minimum density) Succinic acid | No added |
|---|---|---|---|
| 3-1 | C-5 | 0.43 | 0.51 |
| 3-2 | C-6 | 0.44 | 0.52 |
| 3-3 | C-7 | 0.43 | 0.51 |
| 3-4 | C-8 | 0.44 | 0.53 |
| 3-5 | C-9 | 0.43 | 0.51 |
| 3-6 | C-10 | 0.44 | 0.52 |
| 3-7 | C-11 | 0.44 | 0.52 |
| 3-8 | C-12 | 0.43 | 0.51 |
| 3-9 | C-13 | 0.43 | 0.51 |
| 3-10 | CR-1 | 0.52 | 0.66 |

As seen in Table 18, cyan bleach fogging was mitigated by alternating cyan couplers by the cyan couplers preferred for the present invention.

The cyan couplers listed in Table 18 have the following Formulae:

C-5

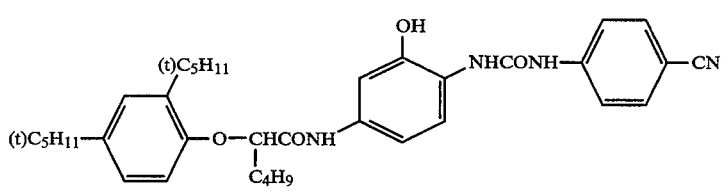

C-6

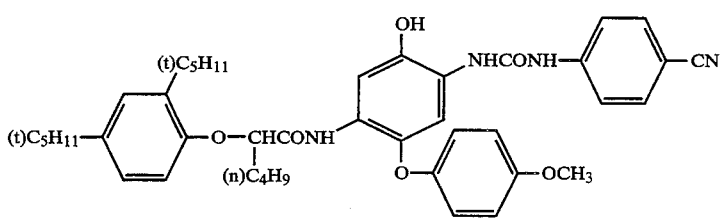

-continued

C-7

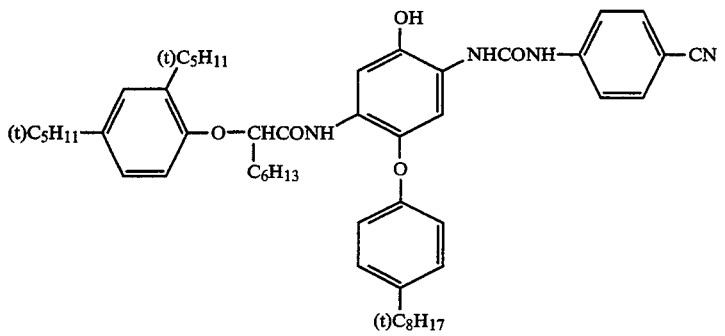

C-8

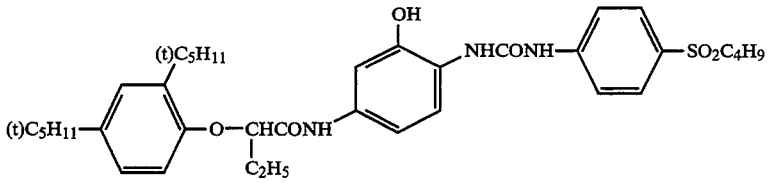

C-9

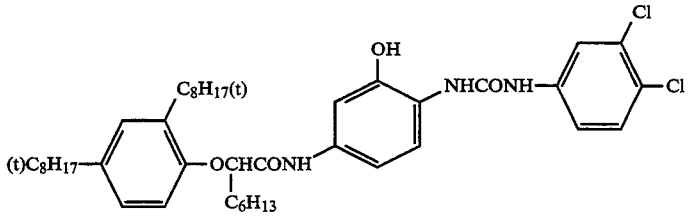

C-10

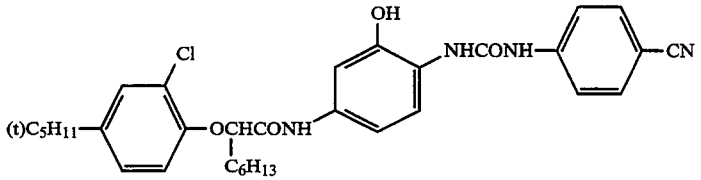

C-11

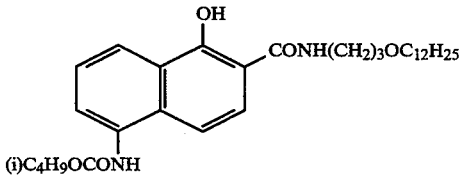

C-12

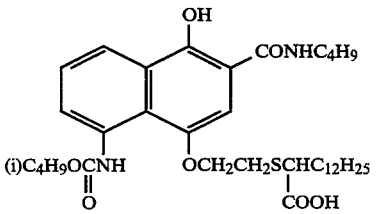

C-13

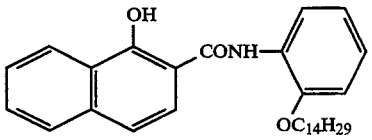

CR-1

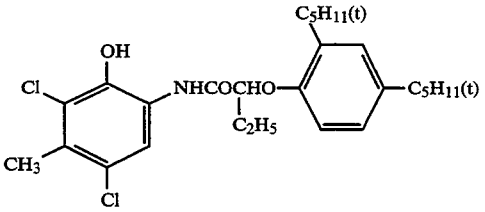

EXAMPLE 13

Processing and evaluation were conducted in the same manner as Experiment Nos. 13 (succinic acid was used as pH buffer) and 20 (no pH buffer) of Example 1, but the magenta couplers listed in Table 19 were used in place of the magenta coupler M-1 in molar amounts equal to those of M-1.

The results for minimum density of magenta dye, determined with green light, are shown in Table 19.

TABLE 19

| Sample No. | Magenta coupler | G (minimum density) Succinic acid | No added |
|---|---|---|---|
| 4-1 | M-4 | 0.57 | 0.68 |
| 4-2 | M-5 | 0.58 | 0.69 |
| 4-3 | M-6 | 0.57 | 0.68 |
| 4-4 | M-7 | 0.57 | 0.68 |
| 4-5 | M-8 | 0.57 | 0.68 |
| 4-6 | M-9 | 0.58 | 0.69 |
| 4-7 | M-10 | 0.58 | 0.69 |
| 4-8 | M coupler-1, for comparison | 0.65 | 0.74 |

TABLE 19-continued
| Sample No. | Magenta coupler | G (minimum density) Succinic acid | No added |
|---|---|---|---|
| 4-9 | M coupler-2, for comparison | 0.63 | 0.71 |
As seen in Table 19, magenta bleach fogging was mitigated by alternating magenta couplers by the magenta couplers preferred for the present invention.
The magenta couplers listed in Table 19 have the following Formulae:
M-4
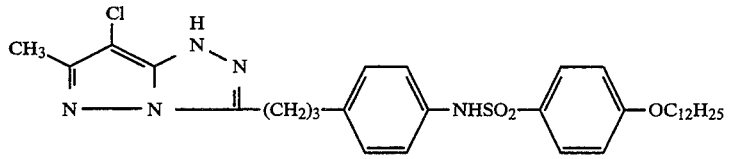
M-5
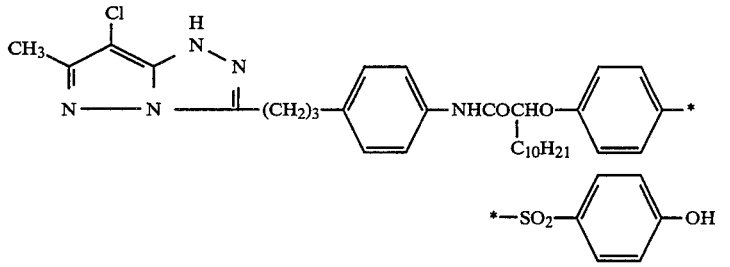
M-6
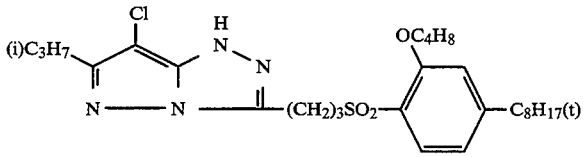
M-7
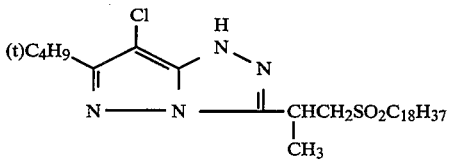
M-8
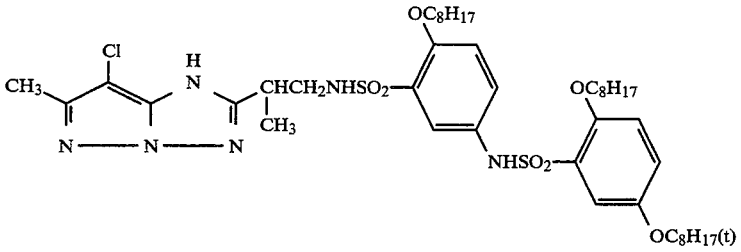
M-9
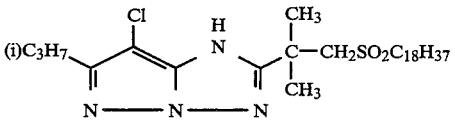
M-10
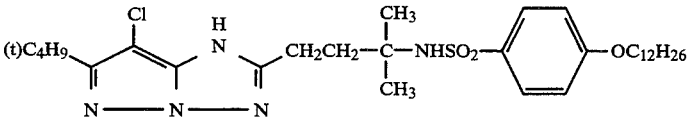
M coupler-1, for comparison -continued

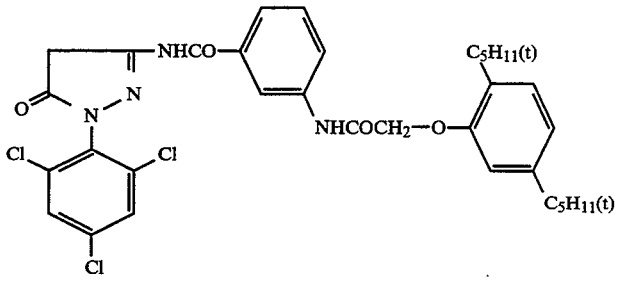

M coupler-2, for comparison

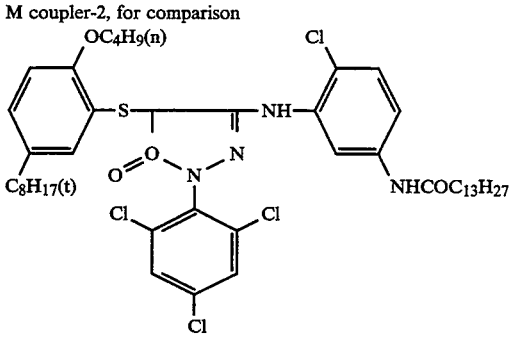

EXAMPLE 14

Developing and bleaching were conducted in the absence/presence of 1.5 mol/l acetic acid or 0.8 mol/l citric acid in the same manner as Example 1 using light-sensitive material sample 1, but the amount of ferric complex salts of aminopolycarboxylic acid as bleaching agents in the bleachers was varied as shown in Table 20, and bleaching time was 3 min. The results are shown in Tables 20 and 21.

TABLE 20

| Ferric salt of A-1 mol/l | Ferric salt of A'-1 mol/l | Not added Minimum density portion B | G | R | Citric acid, 0.8 mol/l Minimum density portion B | G | R | Acetic acid, 1.5 mol/l Minimum density portion B | G | R |
|---|---|---|---|---|---|---|---|---|---|---|
| 0.16 | — | 0.92 | 0.64 | 0.49 | 0.80 | 0.56 | 0 43 | 0.84 | 0.58 | 0.45 |
| 0.2 | — | 0.95 | 0.65 | 0.50 | 0.80 | 0.56 | 0 43 | 0.84 | 0.58 | 0.45 |
| 0.3 | — | 0.97 | 0.66 | 0.51 | 0.80 | 0.56 | 0 43 | 0.84 | 0.58 | 0.45 |
| 0.4 | — | 1.01 | 0.68 | 0.52 | 0.80 | 0.56 | 0 43 | 0.85 | 0.59 | 0.45 |
| 0.16 | 0.08 | 0.91 | 0.64 | 0.49 | 0.80 | 0.56 | 0 43 | 0.84 | 0.58 | 0.45 |
| 0.16 | 0.16 | 0.90 | 0.64 | 0.48 | 0.80 | 0.56 | 0 43 | 0.84 | 0.58 | 0.45 |
| 0.16 | 0.24 | 0.88 | 0.62 | 0.47 | 0.80 | 0.56 | 0 43 | 0.83 | 0.58 | 0.45 |
| 0.16 | 0.3 | 0.86 | 0.60 | 0.46 | 0.80 | 0.56 | 0 43 | 0.83 | 0.58 | 0.44 |
| 0.16 | 0.6 | 0.85 | 0.59 | 0.45 | 0.80 | 0.56 | 0 43 | 0.83 | 0.58 | 0.44 |
| 0.3 | 0.6 | 0.92 | 0.64 | 0.49 | 0.80 | 0.56 | 0 43 | 0.84 | 0.58 | 0.45 |
| 0.6 | 1.0 | 1.04 | 0.70 | 0.53 | 0.80 | 0.56 | 0 43 | 0.85 | 0.59 | 0.45 |

TABLE 21

| Ferric salt of A-1 mol/l | Ferric salt of A'-1 mol/l | Not added Solution surface | Citric acid 0.8 mol/l Solution surface | Acetic acid 1.5 mol/l Solution surface |
|---|---|---|---|---|
| 0.16 | – | ++ | + | – |
| 0.2 | – | ++ | + | – |
| 0.3 | – | +++ | + | – |
| 0.4 | – | +++ | + | – |
| 0.16 | 0.08 | ++ | + | – |
| 0.16 | 0.16 | + | – | – |
| 0.16 | 0.24 | + | – | – |
| 0.16 | 0.3 | – | – | – |
| 0.16 | 0.6 | – | – | – |
| 0.3 | 0.6 | +++ | + | – |

TABLE 21-continued

| Ferric salt of A-1 mol/l | Ferric salt of A'-1 mol/l | Not added Solution surface | Citric acid 0.8 mol/l Solution surface | Acetic acid 1.5 mol/l Solution surface |
|---|---|---|---|---|
| 0.6 | 1.0 | +++ | + | – |

Note:
The evaluation criteria for solution surface are the same as in Example 1.

As seen in Tables 20 and 21, the present invention is very effective when a ferric complex salt of A-1, as the bleaching agent, is present at more than 0.2 mol/l or when the molar ratio of ferric complex salt of aminopolycarboxylic acid contained as the bleaching agent, relative to A'-1, not represented by Formula A, exceeds 40%.

EXAMPLE 15

The light-sensitive material of Example 1 was developed using the processes and processing solutions shown below.

| Process | Processing time | Processing temperature |
|---|---|---|
| Color developing | 1 min 40 sec | 39.8° C. |
| Bleaching | 50 sec | 38° C. |
| Fixing | 50 sec | 38° C. |
| Still water bath | 50 sec | 38° C. |
| Stabilization | 50 sec | 38° C. |
| Drying | 90 sec | 70° C. |

The processing solutions used had the following compositions:

| (Color developer) | |
|---|---|
| Potassium carbonate | 30 g |
| Sodium hydrogencarbonate | 2.5 g |
| Potassium sulfite | 4 g |
| Diethylenetriaminepentaacetic acid | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl)aniline sulfate | 15.0 g |
| Potassium hydroxide | 1.2 g |

Add water to make 1 l, and adjust to pH 10.20 with podassium hydroxide or 50% sulfur ic acid.

| (Bleaching solution) | |
|---|---|
| Ferric ammonium salt of Example A-1 (for amount, see Table 22) | |
| Compound listed in Table 22 (for amount, see Table 22) | |
| Ammonium bromide | 150 g |

Add water to make 1 l, and adjust to pH 4.4 with aqueous ammonia or glacier acetic acid.

| (Fixer) | |
|---|---|
| Ammonium thiosulfate | 180 g |
| Ammonium sulfite | 15 g |
| Ammonium thiocyanate | 180 g |
| Ammonium carbonate | 20 g |

Add water to make 1 l, and adjust to pH 7.5 with acetic acid and aqueous ammonia.

| (Stabilizer) | |
|---|---|
| 5-chloro-2-methyl-4-isothiazolin-3-one | 0.05 g |
| 2-methyl-4-isothiazolin-3-one | 0.05 g |
| Emergen 810 (Surfactant) | 4 ml |
| Add water to make 1 l | |

The sample thus processed was measured for minimum densities for B (blue), G (green) and R (red) using an optical densitometer PDA-65A (Konica Corporation).

TABLE 22

| Amount of A-1 added | Buffer and amount thereof | Bleach fogging (minimum density portion) B | G | R |
|---|---|---|---|---|
| 0.2 mol/l | Succinic acid, 0.005 mol/l | 1.04 | 0.74 | 0.57 |
| | 0.01 mol/l | 0.91 | 0.65 | 0.51 |
| | 0.02 mol/l | 0.88 | 0.63 | 0.48 |
| | 0.05 mol/l | 0.84 | 0.59 | 0.45 |
| | 0.1 mol/l | 0.82 | 0.57 | 0.44 |
| | 0.5 mol/l | 0.82 | 0.57 | 0.44 |
| | 1.0 mol/l | 0.82 | 0.57 | 0.44 |
| | 2.0 mol/l | 0.82 | 0.57 | 0.44 |
| | 3.0 mol/l | 0.82 | 0.57 | 0.44 |
| | 5.0 mol/l | 0.82 | 0.57 | 0.44 |
| | Not added | 1.30 | 0.94 | 0.85 |
| 0.4 mol/l | Succinic acid, 0.005 mol/l | 1.11 | 0.78 | 0.61 |
| | 0.01 mol/l | 1.05 | 0.74 | 0.57 |
| | 0.02 mol/l | 0.99 | 0.70 | 0.53 |
| | 0.05 mol/l | 0.92 | 0.65 | 0.51 |
| | 0.1 mol/l | 0.88 | 0.63 | 0.48 |
| | 0.5 mol/l | 0.84 | 0.59 | 0.45 |
| | 1.0 mol/l | 0.82 | 0.57 | 0.44 |
| | 2.0 mol/l | 0.82 | 0.57 | 0.44 |
| | 3.0 mol/l | 0.82 | 0.57 | 0.44 |
| | 5.0 mol/l | 0.82 | 0.57 | 0.44 |
| | Not added | 1.48 | 1.13 | 0.91 |

As seen in Table 22, it is preferable that a buffer of the present invention be present at ratios of over 0.1 mol/l when a ferric salt of a compound represented by Formula A or B is present at 0.3 to 1 mol per 1 bleaching solution.

What is claimed is:

1. A method for processing a silver halide color photographic light-sensitive material containing color couplers, and a silver chloroiodide or silver iodobromide emulsion, wherein an average silver iodide content of said emulsion is 0.1 mol % to 15 mol %, said method comprising;

imagewise exposing said light-sensitive material to light;

developing said light-sensitive material with a color developer;

bleaching said light-sensitive material, immediately after said developing, with a bleaching solution; and treating said light-sensitive material, after said bleaching, with a fixing solution; wherein said bleaching solution comprises at least one ferric complex salt of a compound represented by Formula A, in an amount of at least 0.01 mol per liter of said bleaching solution;

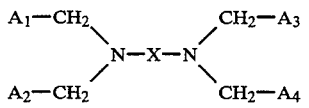

Formula A wherein $A_1$ through $A_4$ are each individually $—CH_2OH$, —COOM, or $—PO_3M_1M_2$; M, $M_1$ and $M_2$ are each hydrogen, sodium, potassium, or an ammonium salt; and X is substituted or unsubstituted alkylene having 3 to 6 carbon atoms, said bleaching solution further containing at least one halide compound; and at least one buffer agent capable of adjusting a pH of said bleaching solution to a value of 3 to 7, said buffer agent being represented by Formula I:

Formula I

A—COOH wherein A is hydrogen or an organic group having not less than 2 carbon atoms;

the pH value of said bleaching solution being 3 to 7, said bleaching step being conducted for not more than 90 seconds with a bleaching solution replenishment rate of 30 to 350 ml/m$^2$ of light-sensitive material.

2. The method of claim 1, wherein pH value of said bleaching solution is held within the range of from 4 to 6.

3. The method of claim 2, wherein pH value of said bleaching solution is held within the range of from 4.5 to 5.8.

4. The method of claim 1, wherein said fixing solution is a fixer.

5. The method of claim 1, wherein said fixing solution is a bleach-fixer.

6. The method of claim 1, wherein said treating step with said fixing solution is carried out for a time of not more than 3 minutes 10 seconds.

7. The method of claim 1, wherein said steps of bleaching and treating with said fixing solution is carried out for a time of not more than 3 minutes 45 seconds in total.

8. The method of claim 1 wherein said replenishment rate is 40 to 300 ml/m$^2$.

9. The method of claim 8 wherein said replenishment rate is 50 to 250 ml/m$^2$.

10. The method of claim 1 wherein said buffer is selected from the group consisting of acrylic acid, adipic acid, acetylenedicarboxylic acid, acetoacetic acid, azelaic acid, isocrotonic acid, isopropylmalonic acid, isobutyric acid, itachonic acid, isovaleric acid, ethylmalonic acid, capronic acid, formic acid, valeric acid, citric acid, glutaric acid, crotonic acid, chlorofumaric acid, α-chloropropionic acid, gluconic acid, glyceric acid, β-chloropropionic acid, succinic acid, cyanoacetic acid, diethylacetic acid, diethylmalonic acid, citraconic acid, dimethylmalonic acid, d-tartaric acid, meso-tartaric acid, trichlorolactic acid, tricarbarylic acid, trimethylacetic acid, lactic acid, vinylacetic acid, pimelic acid, pyrotartaric acid, racemic acid, fumaric acid, propionic acid, propylmalonic acid, maleic acid, malonic acid, mesaconic acid, methylmalonic acid, monochloroacetic acid, n-butyric acid, malic acid, aspartic acid, DL-alanine, glutaminic acid and 3,3-dimethyl-glutaric acid, isophthalic acid, atropic acid, allocinnamic acid, benzoic acid, isophthalic acid, oxybenzoic acid (m-, p-), chlorobenzoic acid (o-, m-, p-), chlorophenylacetic acid (o-, m-, p-), cinnamic acid, salicylic acid, dioxybenzoic acid (2,3-, 2,4-, 2,5-, 2,6-, 3,4-, 3,5), cyclobutane-1,1-dicarboxylic acid, cyclobutane-1,2dicarboxylic acid (trans-, cis-) , cyclopropane-1,1-dicarboxylic acid, cycropropane-1,2-dicarboxylic acid (trans-, cis-) , cyclohexane-1,1-dicarboxylic acid, cyclohexane-1,2-dicarboxylic acid (trans-, cis-) , cyclohexylacetic acid, cyclopentane-1,1dicarboxylic acid, 3 , 5-dinitrobenzoic acid, 2,4dinitrophenoldiphenyl acid, teraphthalic acid, toluic acid (o-, m-, p-), naphthoic acid (α-, β-), nicotinic acid, nitrobenzoic acid, nitrophenylic acid (o-, m-, p-), pyromucoic acid, hippuric acid, picolinic acid, phenylacetic acid, phenyl acid, phthalic acid, fluorobenzoic acid (o-, m-, p-), bromobenzoic acid (o-, m-, p-), hexahydrobenzoic acid, benzylic acid, dl-mandelic acid, mesitylenic acid, methoxybenzoic acid (o-, m-, p-), methoxycinnamic acid (o-, m-, p-), p-methoxyphenylacetic acid, gallic acid, aminobenzoic acid (o-, m-, p-) , N-(2-acetamido) iminodiacetic acid, ethylenediaminediacetic acid, ethylenediamine-2-propionic acid, and β-aminoethyl iminodiacetic acid, amino-methylphosphono-N, N-diacetic acid, 2-phosphonoethyliminodiacetic acid, 2-phosphonobutane-1,2,4-tricarboxylic acid, and acids represented by the following formulas:

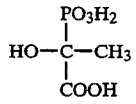
(P-1)

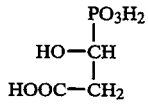
(P-2)

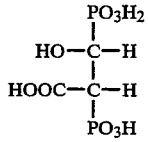
(P-3)

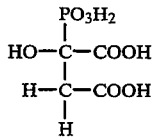
(P-4)

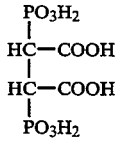
(P-5)

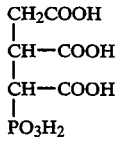
(P-6)

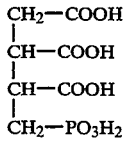
(P-7)

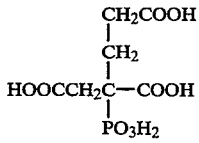
(P-8)

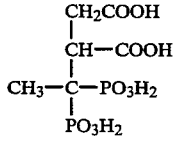
(P-9)

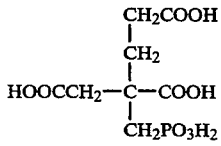
(P-10)

-continued (P-11)

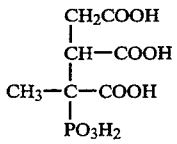

(P-12)

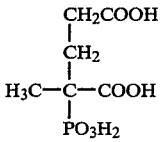

(P-13)

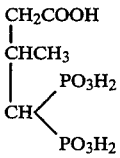

(P-14)

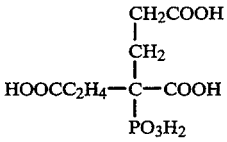

(P-15)

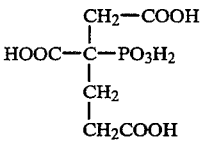

(P-16)

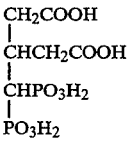

(P-17)

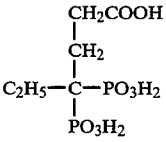

(P-18)

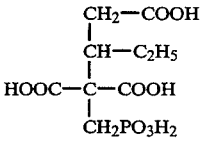

-continued (P-19)

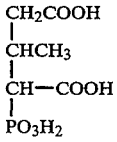

(P-20)

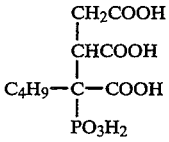

(P-21)

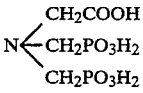

(P-22)

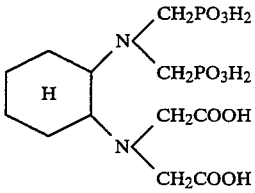

(P-23)

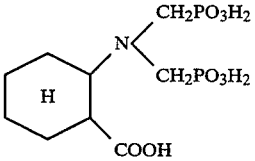

(P-30)

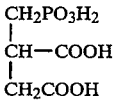

(P-31)

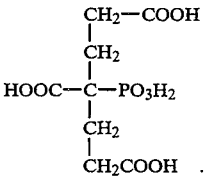

11. The method of claim 1 wherein said buffer is selected from the group consisting of acrylic acid, adipic acid, acetoacetic acid, isopropylmalonic acid, isobutyric acid, itachonic acid, formic acid, valeric acid, citric acid, glutaric acid, succinic acid, diethylmalonic acid, d-tartaric acid, fumaric acid, malonic acid, n-butylic acid, malic acid, and glutamic acid.

* * * * *